US011204569B2

(12) United States Patent
Sakai et al.

(10) Patent No.: US 11,204,569 B2
(45) Date of Patent: Dec. 21, 2021

(54) IMAGE FORMING APPARATUS FIXING TONER IMAGE ONTO SHEET AND CONTROL METHOD

(71) Applicant: Konica Minolta Inc., Tokyo (JP)

(72) Inventors: Tetsuya Sakai, Toyokawa (JP); Yoshinori Tsutsumi, Toyokawa (JP); Kenji Tsuru, Toyokawa (JP); Munenori Nakano, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/851,796

(22) Filed: Apr. 17, 2020

(65) Prior Publication Data

US 2020/0333739 A1 Oct. 22, 2020

(30) Foreign Application Priority Data

Apr. 18, 2019 (JP) ..... JP2019-079235

(51) Int. Cl.
*G03G 15/20* (2006.01)
*G03G 15/00* (2006.01)
*G03G 15/01* (2006.01)

(52) U.S. Cl.
CPC ..... *G03G 15/20* (2013.01); *G03G 15/0136* (2013.01); *G03G 15/556* (2013.01); *G03G 15/6564* (2013.01); *G03G 15/6573* (2013.01)

(58) Field of Classification Search
CPC ..... G03G 15/136; G03G 15/6564
See application file for complete search history.

(56) References Cited

U.S. PATENT DOCUMENTS 5,239,348 A * 8/1993 Fukuchi ..... G03G 15/0105 399/45
2012/0014702 A1* 1/2012 Takemura ..... G03G 15/205 399/46

FOREIGN PATENT DOCUMENTS

JP 2018194791 A 12/2018
JP 2019012174 A 1/2019

* cited by examiner

*Primary Examiner* — Victor Verbitsky
(74) *Attorney, Agent, or Firm* — Cantor Colburn LLP

(57) ABSTRACT

An image forming apparatus fixes a toner image onto a sheet by a fixer, and includes: a re-feeding path that normally conveys the sheet having passed through the fixer and guides the sheet toward the fixer; and a hardware processor that switches between first control to discharge the sheet having passed through the fixer toward a discharge destination and second control to re-feed the sheet having passed through the fixer to the fixer through the re-feeding path, depending on a type of an image which is a source of formation of the toner image.

11 Claims, 9 Drawing Sheets

FIG. 3A

200

| IMAGE ATTRIBUTE / COLOR ATTRIBUTE | GRAPHIC IMAGE, CHARACTER IMAGE | SOLID IMAGE |
|---|---|---|
| TWO OR MORE REPRODUCED COLORS | FIXATION ONCE | FIXATION TWICE |
| SINGLE REPRODUCED COLOR | FIXATION ONCE | FIXATION ONCE |

FIG. 3B

210

| IMAGE ATTRIBUTE / COLOR ATTRIBUTE | GRAPHIC IMAGE, CHARACTER IMAGE | SOLID IMAGE |
|---|---|---|
| TWO OR MORE REPRODUCED COLORS | FIXATION TWICE | FIXATION THREE TIMES |
| SINGLE REPRODUCED COLOR | FIXATION TWICE | FIXATION TWICE |

IMAGE FORMING APPARATUS FIXING TONER IMAGE ONTO SHEET AND CONTROL METHOD

CROSS REFERENCE TO RELATED APPLICATIONS

The present invention claims priority under 35 U.S.C. § 119 to Japanese patent Application No. 2019-079235, filed on Apr. 18, 2019, the entire content of which is incorporated herein by reference.

BACKGROUND

Technological Field

The present invention relates to a technique for fixing a toner image transferred on a sheet onto the sheet in an electrophotographic image forming apparatus.

Description of the Related Art

Conventionally, in electrophotographic image forming apparatuses, a sheet on which a toner image has been transferred is caused to pass through a nip formed by pressing a pressure member against a heated fixing member so as to fix the toner image onto the sheet.

According to JP 2018-194791 A, when a sheet is embossed paper, the sheet is caused to pass through a nip, and then, is caused to pass through the nip again. As a result, the amount of heat applied to the sheet is increased, and a fixing property of a toner is improved.

According to JP 2019-12174 A, an image forming apparatus includes a first heater that fixes a toner image on a sheet and a second heater that re-heats the sheet on which the toner image has been fixed, and changes a heating condition of the second heater depending on the glossiness and basis weight of the sheet. As a result, the glossiness of the sheet and the glossiness of the toner image are made substantially the same, thereby providing a high-quality image without causing a sense of incompatibility.

In this manner, the amount of heat applied to the sheet is increased or decreased depending on the type, basis weight, or the like of the sheet according to JP 2018-194791 A and JP 2019-12174 A.

As in JP 2018-194791 A or JP 2019-12174 A, it is considered a method of applying a first amount of heat to plain paper and applying a second amount of heat larger than the first amount of heat to thick paper thicker than the plain paper by controlling the number of times of the passage through the nip or by changing the heating condition of the second heater depending on the type, basis weight, or the like of the sheet.

However, when a sheet is plain paper and a photographic image including two or more reproduced colors is formed as a toner image on the sheet, toner particles are densely present on the sheet and toner particles of two or more colors are stacked, and thus, the amount of heat for fixing the toner image is insufficient if the first amount of heat corresponding to the plain paper is applied, and there is a possibility that the fixation becomes insufficient.

On the contrary, when a sheet is thick paper and only a character image including the single reproduced color is formed as a toner image on the sheet, discrete toner particles are present on the sheet, and thus, the amount of heat for fixing the toner image is excessive if the second amount of heat corresponding to the thick paper is applied, and the loss of the amount of heat increases.

SUMMARY

The present invention has been made to solve the above problems, and an object thereof is to provide an image forming apparatus capable of appropriately fixing a toner image onto a sheet depending on the toner image, and a method of controlling the image forming apparatus.

To achieve the abovementioned object, according to an aspect of the present invention, there is provided an image forming apparatus that fixes a toner image onto a sheet by a fixer, and the image forming apparatus reflecting one aspect of the present invention comprises: a re-feeding path that normally conveys the sheet having passed through the fixer and guides the sheet toward the fixer; and a hardware processor that switches between first control to discharge the sheet having passed through the fixer toward a discharge destination and second control to re-feed the sheet having passed through the fixer to the fixer through the re-feeding path, depending on a type of an image which is a source of formation of the toner image.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 3A is a view showing a number-of-fixations table in the case of smooth paper;

FIG. 3B is a view showing a number-of-fixations table in the case of embossed paper;

DETAILED DESCRIPTION OF EMBODIMENTS

Hereinafter, one or more embodiments of the present invention will be described with reference to the drawings. However, the scope of the invention is not limited to the disclosed embodiments.

1 Embodiment 1.1 Image Forming Apparatus 1

An image forming apparatus 1 is a tandem-type color MultiFunction Peripheral (MFP) having functions such as a scanner, a printer, and a copier.

Figure 1:
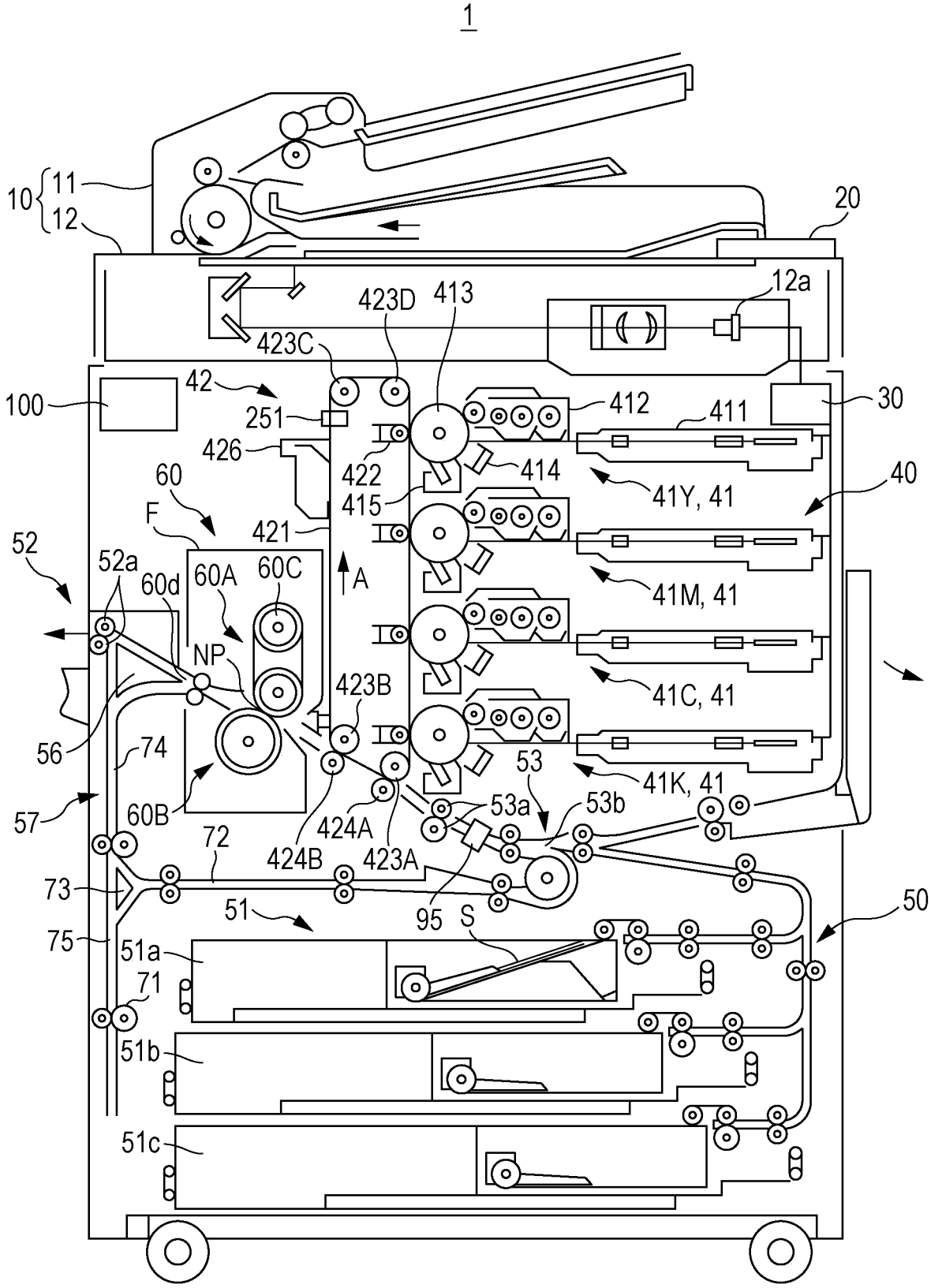
FIG. 1 is a view schematically showing an overall configuration of an image forming apparatus as an embodiment.

In the image forming apparatus 1, a sheet conveyer 50 that accommodates and conveys a sheet is provided at the bottom of a housing as shown in FIG. 1. Above the sheet conveyer 50, an image forming part 40 that forms an image using an electrophotographic system and a fixer 60 (fixer) that fuses a toner image to a sheet are provided. Above the image forming part 40 and the fixer 60, a controller 100 that integrally controls each block of the image forming apparatus 1, an image reader 10 (an image acquisition part and a job reception part) that reads a document and generates input image data, and an operation display 20 that displays an operation screen and receives an input operation from a user are provided.

(1) Image Reader 10

The image reader 10 includes an automatic document feeder 11 called an auto document feeder (ADF), a document image scanner 12 (scanner), and the like.

The automatic document feeder 11 conveys a document placed on a document tray by a conveyance mechanism to be sent to the document image scanner 12. The automatic document feeder 11 can successively convey a large number of documents placed on the document tray.

The document image scanner 12 optically scans a document conveyed on the contact glass or a document placed on a contact glass from the automatic document feeder 11, images light reflected from the document on a light receiving surface of a charge coupled device (CCD) sensor 12*a* to read the document image. The image reader 10 generates input image data based on a read result of the document image scanner 12. The image reader 10 writes the generated input image data into an image memory 80 (FIG. 2).

(2) Operation Display 20

Figure 2:
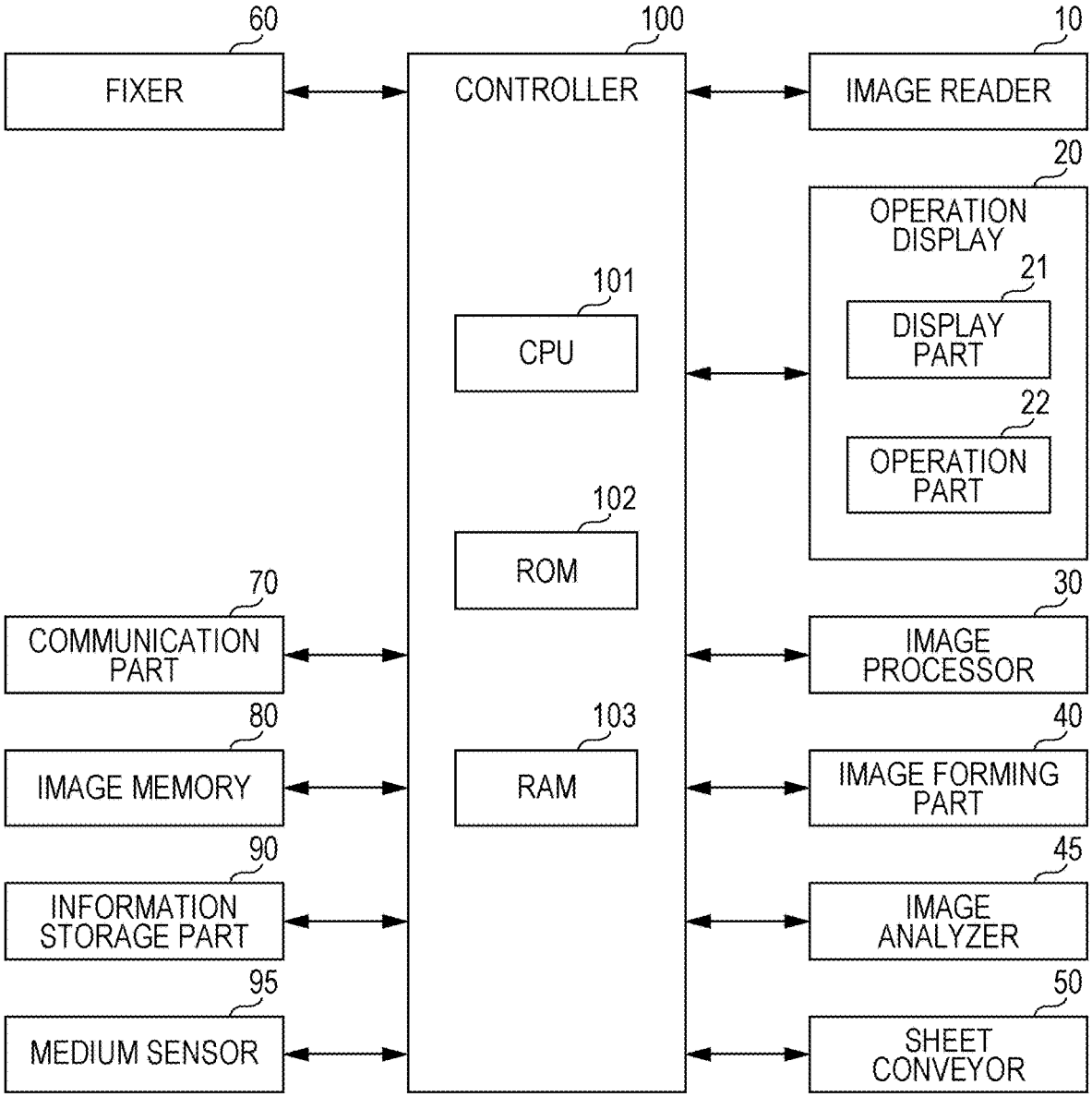
FIG. 2 is a configuration diagram showing a configuration of a controller and a relationship thereof with other constituent parts of the image forming apparatus.

The operation display 20 includes a display part 21 and an operation part 22 (FIG. 2). The display part 21 displays various operation screens, an operation state of each function, and the like according to a display control signal output by the controller 100. The operation part 22 includes a touch panel that receives user's touch operation, a numeric keypad, and various operation keys such as a start key, receives various input operations from the user, and outputs an operation signal to the controller 100. The operation display 20 is formed by, for example, a liquid crystal display (LCD) equipped with a touch panel.

(3) Image Processor 30

An image processor 30 includes a circuit that performs digital image processing according to initial settings or user settings on input image data stored in the image memory 80. For example, the image processor 30 performs tone correction based on tone correction data (tone correction table) under the control of the controller 100. In addition to the tone correction, the image processor 30 performs various correction processes such as color correction and shading correction, a compression process, and the like on the input image data stored in the image memory 80. Further, the image processor 30 executes various digital processes on the input image data formed of multi-valued digital signals of red (R), green (G), and blue (B) to convert the input image data into input image data of each reproduced color of yellow (Y), magenta (M), cyan (C), and black (K). The image forming part 40 is controlled based on the input image data on which these processes have been performed.

(4) Image Forming Part 40

The image forming part 40 includes: image forming units 41Y, 41M, 41C, and 41K, an intermediate transfer unit 42, and the like to form images using color toners of a Y component, an M component, a C component, and a K component based on the input image data stored in the image memory 80.

The image forming units 41Y, 41M, 41C, and 41K for the Y component, the M component, the C component, and the K component have the same configuration. For convenience of illustration and description, common constituent parts are denoted by the same reference signs, and Y, M, C, or K is added to the reference signs when the constituent parts are distinguished from each other. In FIG. 1, reference signs are assigned only to constituent parts of the image forming unit 41Y for the Y component, and reference signs are omitted for constituent parts of the other image forming units 41M, 41C, and 41K. Hereinafter, the image forming unit 41Y will be described as the image forming unit 41 as a representative of the image forming units 41Y, 41M, 41C, and 41K.

The image forming unit 41 includes an exposure device 411, a developing device 412, a photoconductor drum 413, a charging device 414, a drum cleaning device 415, and the like.

The photoconductor drum 413 rotates at a constant peripheral speed as the controller 100 controls a drive current supplied to a drive motor (not shown) rotating the photoconductor drum 413.

The charging device 414 uniformly charges the surface of the photoconductor drum 413 to a negative polarity.

The exposure device 411 is formed by, for example, a semiconductor laser, and irradiates the photoconductor drum 413 with laser light corresponding to an image of each color component. With the irradiation of the laser light, an electrostatic latent image of each color component is formed on the surface of the photoconductor drum 413.

The developing device 412 is, for example, a two-component developing type developing device, and attaches a toner of each color component to the surface of the photoconductor drum 413 to visualize the electrostatic latent image and form the toner image.

The drum cleaning device 415 has a drum cleaning blade or the like that slides on the surface of the photoconductor drum 413, and removes a transfer residual toner remaining on the surface of the photoconductor drum 413 after the primary transfer.

The intermediate transfer unit 42 includes an intermediate transfer belt 421, a plurality of primary transfer rollers 422, a plurality of support rollers 423A to 423D, secondary transfer rollers 424A and 424B, a belt cleaning device 426, and the like.

The intermediate transfer belt 421 is formed by an endless belt, and is stretched in a loop by the plurality of support rollers 423A to 423D. Among the plurality of support rollers 423A to 423D, the support roller 423A is a drive roller. As the support roller 423A rotates, the intermediate transfer belt 421 circulates at a constant speed in a direction of arrow A.

The primary transfer roller 422 of each color component is arranged on the inner peripheral surface side of the intermediate transfer belt 421 so as to oppose the photoconductor drum 413 of the color component. As the primary transfer roller 422 is pressed against the photoconductor drum 413 with the intermediate transfer belt 421 interposed therebetween, a primary transfer nip for transferring a toner image from the photoconductor drum 413 to the intermediate transfer belt 421, is formed.

The secondary transfer rollers 424A and 424B are arranged on the outer peripheral surface side of the intermediate transfer belt 421 so as to oppose the support rollers 423A and 423B arranged on the inner peripheral surface side of the intermediate transfer belt 421. As the secondary transfer rollers 424A and 424B are pressed against the support rollers 423A and 423B, respectively, with the intermediate transfer belt 421 interposed therebetween, a secondary transfer nip for transferring a toner image from the intermediate transfer belt 421 to a sheet S, is formed.

When the intermediate transfer belt 421 passes through the primary transfer nip, toner images on the photoconductor drum 413 are primarily transferred to the intermediate transfer belt 421 to be sequentially superimposed on each other.

Thereafter, when the sheet S passes through the secondary transfer nip, the toner image on the intermediate transfer belt 421 are secondarily transferred onto the sheet S. The sheet S to which the toner image has been transferred is conveyed toward the fixer 60.

The belt cleaning device 426 has a belt cleaning blade or the like that slides on the surface of the intermediate transfer belt 421, and removes a transfer residual toner remaining on the surface of the intermediate transfer belt 421 after the secondary transfer.

(5) Fixer 60

The fixer 60 is provided on the downstream side in a conveying direction of the sheet S from the secondary transfer nip. The fixer 60 includes: a fixing member 60A having a fixing-surface-side member arranged on a fixing surface (surface on which the toner image has been formed) side of the sheet S; a pressure member 60B having a back-surface-side support member arranged on a back surface (opposite to the fixing surface) side of the sheet S; and a heating source 60C applying heat to the fixing member 60A. As the back-surface-side support member is pressed against the fixing-surface-side member, a fixing nip NP that nips and conveys the sheet S is formed.

The fixer 60 heats and pressurizes the sheet S conveyed from the secondary transfer nip at the fixing nip NP. The sheet S that has passed through the fixing nip NP is conveyed from a discharge port 60*d* toward a sheet guide member 56 to be described later.

(6) Sheet Conveyer 50

The sheet conveyer 50 includes a feeder 51, a conveyance path part 53, a re-feeder 57 (re-feeding path), a discharger 52 (a discharge destination), and the like. The sheet conveyer 50 is controlled according to an instruction from the controller 100.

The feeder 51 is provided at the bottom of the housing of the image forming apparatus 1, and the conveyance path part 53 is provided on the downstream side in the conveying direction of the sheet fed from the feeder 51. In addition, the re-feeder 57 is provided as a path that re-feeds the sheet S discharged from the fixer 60 toward the conveyance path part 53 between a connection port 53*b* connecting the feeder 51 and the conveyance path part 53, and the discharge port 60*d* of the fixer 60.

The feeder 51 includes three feeding tray units 51*a* to 51*c*. Sheets classified according to sizes are accommodated in the feeding tray units 51*a* to 51*c*, respectively. The sheets S stored in the feeding tray units 51*a* to 51*c* are sent out one by one from the top to be conveyed to the conveyance path part 53.

The conveyance path part 53 includes a plurality of conveyance roller pairs such as a registration roller pair 53*a*. When the sheet S is conveyed from the feeder 51 to the conveyance path part 53, the registration roller pair 53*a* corrects skew of the sheet S and adjusts a conveyance timing. Thereafter, the sheet S is conveyed toward the secondary transfer nip.

In the conveyance path part 53, a medium sensor 95 is provided on the upstream side of the registration roller pair 53*a* in the conveying direction of the sheet S. The medium sensor 95 will be described later.

The re-feeder 57 includes the sheet guide member 56, a sheet guide member 73, a re-feeding reversal roller 71, a conveyance path 72, a conveyance path 74, a conveyance path 75, and the like.

The re-feeder 57 normally conveys the sheet S that has passed through the fixer 60 such that the fixing surface of the toner image is thermo-compressed again, and guides the sheet S toward the fixer 60.

The sheet guide member 56 is provided at a position close to the discharger 52 on the downstream side of the sheet S in the conveying direction of the sheet S from the discharge port 60*d* of the fixer 60. The sheet guide member 56 switches a conveyance path of the sheet S conveyed from the fixer 60 to either the discharger 52 side or the fixer 60 side under the control of the controller 100. In this manner, the controller 100 and the sheet guide member 56 constitute a switcher.

That is, the controller 100 and the sheet guide member 56 switches between first control to discharge a sheet that has passed through the fixer 60 toward the discharger 52, which is a discharge destination, and second control to re-feed the sheet that has passed through the fixer 60 to the fixer 60 through the re-feeder 57, which is a re-feeding path, depending on a type of an image and a type of the sheet.

The conveyance path 74 extending downward in the vertical direction is provided from the sheet guide member 56, and the sheet guide member 73 is provided at the extension of the conveyance path 74.

Under the control of the controller 100, the sheet guide member 73 switches the conveyance path of the sheet S conveyed from the sheet guide member 56 either to the conveyance path 72 side extending in the horizontal direction or to the conveyance path 75 side extending downward in the vertical direction.

The re-feeding reversal roller 71 is provided on the conveyance path 75. Under the control of the controller 100, the re-feeding reversal roller 71 nips a rear end of the sheet S conveyed from the sheet guide member 73, and then, rotates in the reverse direction to reverse the conveying direction of the sheet S, and conveys the sheet S toward the sheet guide member 73. The sheet S conveyed to the sheet guide member 73 is conveyed toward the conveyance path 72 by switching of the sheet guide member 73.

The conveyance path 72 is connected to the connection port 53*b*, and guides the conveyed sheet S toward the conveyance path part 53 by switching of the sheet guide member 73.

The discharger 52 includes a discharge roller 52*a*. The sheet S conveyed from the sheet guide member 56 is discharged outside the apparatus by the discharge roller 52*a*.

1.2 Conveyance Path for Each Case

(1) Case of forming Image on Back Surface of Sheet S

In the case of forming an image on not only the front surface of a sheet S but also the back surface of the sheet S, the sheet S that has completed the image fixing on the front surface is conveyed downward in the vertical direction by switching a conveyance path with the sheet guide member 56.

The re-feeding reversal roller 71 nips a rear end of the sheet S, and then, rotates in the reverse direction to reverse the conveying direction of the sheet S, and sends the sheet S toward the sheet guide member 73. The sheet guide member 73 sends the sheet S conveyed from the re-feeding reversal roller 71 to the conveyance path 72 by switching. Here, the conveyance for reversing the conveying direction of the sheet S is referred to as switchback conveyance (reversal conveyance). In addition, the conveyance without reversing the conveying direction of the sheet S, that is, the conveyance for conveying the sheet to the conveyance path part 53 via the conveyance path 74, the sheet guide member 73, and the conveyance path 72 is referred to as forward conveyance (normal conveyance). The sheet S is sent from the conveyance path 72 to the conveyance path part 53. The sheet S is conveyed to the image forming part 40 by the conveyance path part 53. Next, a toner image is secondarily transferred to the back surface of the sheet S in the image forming part 40, and a fixing step is performed in the fixer 60. The sheet S on which the images have been formed on both the surfaces is discharged outside the apparatus by the discharger 52 having the discharge roller 52*a*.

(2) Case of Embossed Paper

In the case of a sheet S having an embossed surface in the present embodiment, the sheet S that has completed the image fixation on the embossed surface is conveyed downward in the vertical direction by the sheet guide member 56, and the sheet S is sent from the conveyance path 72 to the conveyance path part 53 after the switchback conveyance. Then, the sheet S is conveyed to the image forming part 40 by the conveyance path part 53. The sheet S is conveyed to the fixer 60 without transferring a toner image in the image forming part 40. The sheet S is subjected to second heating and pressurization when passing through the fixer 60, and is discharged outside the apparatus by the discharger 52 provided with the discharge roller 52*a*. Therefore, the sheet passes through the fixer 60 twice in the case of the sheet S having the embossed surface.

Note that the sheet S conveyed downward in the vertical direction by the sheet guide member 56 is not necessarily subjected to the switchback conveyance. That is, the sheet guide member 73 may convey the sheet S conveyed from the sheet guide member 56 toward the conveyance path 72.

(3) Case of Smooth Paper

In the case of a sheet S having a smooth surface, such as coated paper, in the present embodiment, when the sheet S is caused to pass through the fixer 60 twice by satisfying a condition to be described later, the sheet S that has completed the first image fixation in the fixer 60 is conveyed toward the sheet guide member 73 on the vertically lower side by the sheet guide member 56, and the sheet S is sent from the conveyance path 72 to the conveyance path part 53 by the forward conveyance, and then, is conveyed to the image forming part 40 by the conveyance path part 53. The sheet S is conveyed to the fixer 60 without transferring a toner image in the image forming part 40. The sheet S is subjected to second heating and pressurization when passing through the fixer 60, and is discharged outside the apparatus by the discharger 52 provided with the discharge roller 52*a*. In this manner, when a certain condition is satisfied in the case of the sheet S having the smooth surface, the sheet passes through the fixer 60 twice.

1.3 Controller 100 and Peripheral Constituent Parts Thereof

The image forming apparatus 1 includes an image analyzer 45, a communication part 70, the image memory 80, and an information storage part 90 as shown in FIG. 2 in addition to the image reader 10, the operation display 20, the image processor 30, the image forming part 40, the sheet conveyer 50, the fixer 60, the medium sensor 95, and the controller 100 shown in FIG. 1.

(1) Image Analyzer 45

The image analyzer 45 includes a microprocessor and a memory. The memory stores a computer program for control, and the microprocessor operates according to the computer program. As a result, the image analyzer 45 serves its function.

(Image Division)

The image analyzer 45 mainly performs image analysis on input image data stored in the image memory 80 to divide the entire image into the following three areas when the input image data has been written in the image memory 80 by the image reader 10.

- A first area having a size equal to or larger than a predetermined value in which all pixels have pixel values (an image arranged in the first area is sometimes referred to as a partial image)
- A second area in which a plurality of pixels having pixel values are arranged at predetermined intervals or more
- A third area in which all included pixels have no pixel value Note that it is unnecessary to perform the image division for input image data that has been acquired from an external device (for example, a personal computer) via the communication part 70 and already includes the first area, the second area, and the third area by a computer program for document creation.

Hereinafter, the first area, the second area, and the third area will be specifically described.

(First Area)

The first area is, for example, an area where a photographic image or a solid image has been arranged. All the pixels included in the first area have pixel values. Note that all the pixels included in the first area may have pixel values equal to or larger than a threshold.

The first area has a size equal to or larger than a predetermined value.

The first area may include the single reproduced color among yellow, magenta, cyan, black, and the like. In addition, the first area may have two or more reproduced colors among yellow, magenta, cyan, black, and the like.

The possibility that gloss unevenness in the first area is visually recognized by a human is low when a sheet to which a toner image has been transferred is heated and pressurized by a normal fixing method (for example, one-time fixation) using the fixer 60, when the size of the first area is smaller than the predetermined value, or when the single reproduced color is arranged, based on the input image data. On the other hand, when the size of the first area is equal to or larger than the predetermined value and two or more reproduced colors are arranged, the possibility that the gloss unevenness in the first area is visually recognized by the human is high.

Regarding the predetermined value, for example, when the first area is rectangular, a width and a height there of are each 10 mm, for example. It is considered that this predetermined value depends on various factors, for example, the order in which toner particles of reproduced colors are superimposed, components contained in the toner particles, a type of a sheet, and the like.

(Second Area)

The second area is the area in which a plurality of pixels having pixel values are arranged at predetermined intervals or more.

In the second area, a character image, such as a number, an alphabet, Kanji, a Kana character, and a symbol, is arranged. In addition, a line image having a line drawing, such as a straight line and a curve, is arranged in the second area.

Here, the character image or the line image of the second area may have the single reproduced color among yellow, magenta, cyan, black, and the like or may have two or more reproduced colors.

When a sheet to which a toner image has been transferred is heated and pressurized by a normal fixing method (for example, one-time fixation) using the fixer 60 based on the input image data, the possibility that gloss unevenness in the image of the second area is visually recognized by a human is low.

If a part of the character or the line drawing is equal to or larger than the predetermined value, such an area is determined to be the first area.

(Third Area)

The third area is the area in which all included pixels have no pixel value.

When a sheet to which a toner image has been transferred is heated and pressurized by a normal fixing method (for example, one-time fixation) using the fixer 60 based on the input image data, gloss unevenness in the third area is not visually recognized by a human.

(Setting of Image Attribute)

For each area obtained by the division, the image analyzer 45 sets an image attribute indicating any one of the first area, the second area, and the third area.

(Setting of Color Attribute)

In addition, the image analyzer 45 determines whether each area includes only the single reproduced color or has a superimposition of two or more reproduced colors. Here, the single reproduced color is Y, M, C or K.

For each area, the image analyzer 45 sets a color attribute indicating whether each area includes only the single reproduced color or has the superimposition of two or more reproduced colors.

For each area of the input image data, the image analyzer 45 writes the image attribute and the color attribute in the information storage part 90 together with a position and a size of the area. Note that the image attribute and the color attribute are referred to as an image type.

(2) Information Storage Part 90

The information storage part 90 includes a semiconductor memory or a hard disk drive.

The information storage part 90 stores a number-of-fixations table 200 shown in FIG. 3A and a number-of-fixations table 210 shown in FIG. 3B in advance.

(Number-of-Fixations Table 200)

The number-of-fixations table 200 is used by the controller 100 to determine a fixing condition when a medium type of the sheet S is smooth paper (coated paper). Here, the fixing condition is the number of times of causing the sheet S to pass through the fixing nip NP of the fixer 60. The number of times is either once or twice.

The number-of-fixations table 200 stores the number of fixations of causing the passage through the fixer 60 for each combination of an image attribute and a color attribute.

As shown in FIG. 3A, when the image attribute indicates that an area (for example, an area formed of a graphic image or a character image) is not the first area (for example, an area formed of a solid image), the number of fixations of causing the passage through the fixer 60 is once regardless of whether the area includes only the single reproduced color or the superimposition of two or more reproduced colors based on the color attribute.

When the image attribute indicates that the area is the first area and the color attribute indicates that the area includes only the single reproduced color, the number of fixations that causes the passage through the fixer 60 is once.

On the other hand, when the image attribute indicates that the area is the first area and the color attribute indicates that the area includes the superimposition of two or more reproduced colors, the number of fixations that causes the passage through the fixer 60 is twice.

(Number-of-Fixations Table 210)

The number-of-fixations table 210 is used by the controller 100 to determine a fixing condition when a medium type of the sheet S is embossed paper. Here, the fixing condition is the number of times of causing the sheet S to pass through the fixing nip NP of the fixer 60. The number of times is either twice or three times.

Note that the embossed paper is manufactured, for example, by drawing base paper through a nip between a metal roll having an engraved pattern such as satin, cloth, and mesh, and an elastic roll.

The number-of-fixations table 210 stores the number of fixations of causing the passage through the fixer 60 for each combination of an image attribute and a color attribute.

As shown in FIG. 3B, when the image attribute indicates that an area (for example, an area formed of a graphic image or a character image) is not the first area (for example, an area formed of a solid image), the number of fixations of causing the passage through the fixer 60 is twice regardless of whether the area includes only the single reproduced color or the superimposition of two or more reproduced colors based on the color attribute.

When the image attribute indicates that the area is the first area and the color attribute indicates that the area includes only the single reproduced color, the number of fixations that causes the passage through the fixer 60 is twice.

On the other hand, when the image attribute indicates that the area is the first area and the color attribute indicates that the area includes the superimposition of two or more reproduced colors, the number of fixations that causes the passage through the fixer 60 is three times.

(3) Communication Part 70

The communication part 70 is formed by, for example, a communication control card such as a local area network (LAN) card, and is connected to a communication network such as a LAN and a wide area network (WAN). In addition, an external device (for example, a personal computer) is connected to the communication network. The communication part 70 (an image acquisition part and a job reception part) receives input image data from the external device via the communication network, for example. The communication part 70 writes the received input image data into the image memory 80. An image is formed on a sheet S based on the input image data written in the image memory 80.

(4) Medium Sensor 95

As described above, the medium sensor 95 is provided on the upstream side of the registration roller pair 53*a* in the conveying direction of the sheet S in the conveyance path part 53 (FIG. 1).

Figure 4:
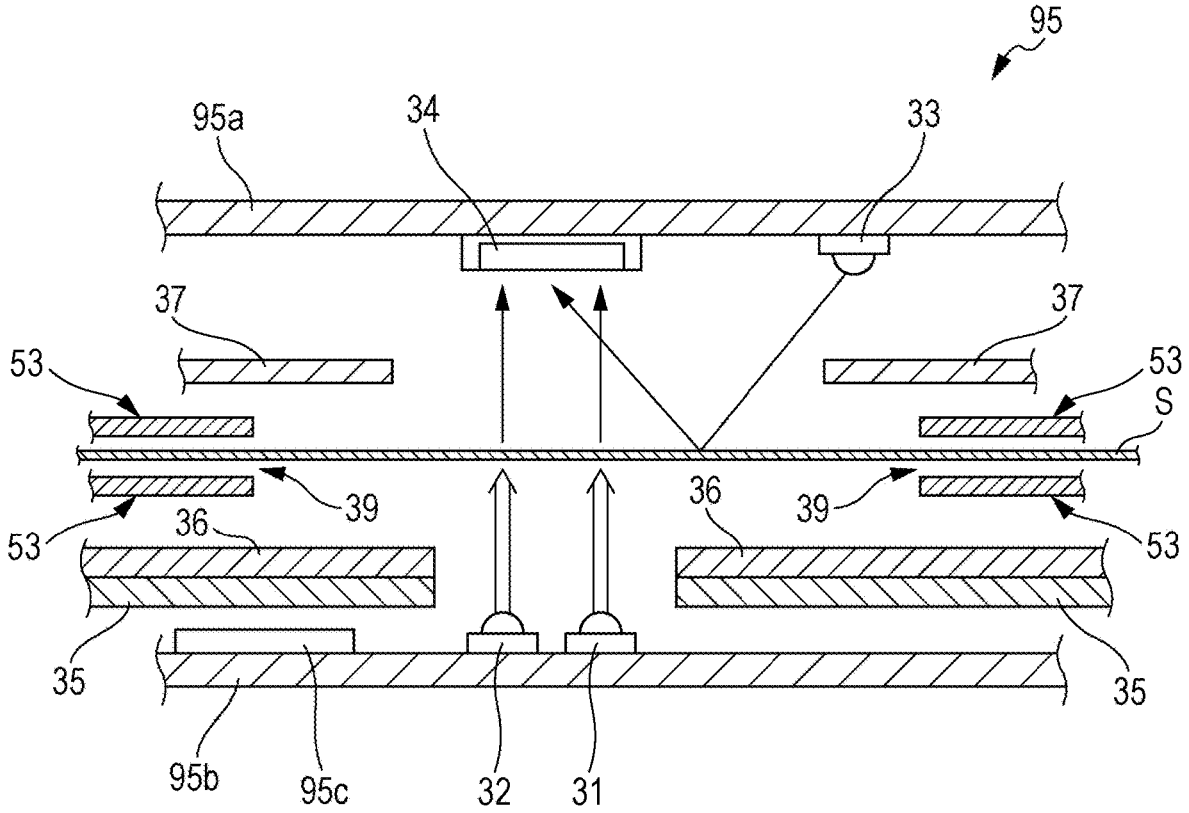
FIG. 4 is a view showing a configuration of a medium sensor.

In the medium sensor 95, a light emitting element 31 (a light emitter and a light source for transmission), which emits blue light (whose wavelength is, for example, 470 nm) toward the back surface (surface opposite to the side where the toner image is formed by the image forming part 40) of the sheet S passing through the conveyance path 39 of the conveyance path part 53, and a light emitting element 32 (a light emitter and a light source for transmission), which emits blue light (whose wavelength is, for example, 470 nm) toward the back surface of the sheet S, are provided on an upper surface of a lower housing 95*b* of the medium sensor 95, as shown in FIG. 4. In this manner, the wavelength of light emitted from the light emitting element 31 and the wavelength of light emitted from the light emitting element 32 are the same. In addition, a light emitting element 33 (a light emitter and a light source for reflection), which emits green light (whose wavelength is, for example, 520 nm) toward the front surface (surface where the toner image is formed by the image forming part 40) of the sheet, and a light receiving element 34 (a light receiver), which receives transmission light having been emitted from the light emitting element 31 and the light emitting element 32 and transmitted through the sheet S and reflection light having been emitted from the light emitting element 33 and reflected from the sheet S or a reference plate 36 to be described later, are provided on a lower surface of an upper housing 95*a* of the medium sensor 95.

In addition, a shielding plate 37, which shields light emitted from the light emitting elements 31, 32, and 33, is provided between the upper housing 95*a* and the conveyance path 39 to be substantially parallel to the conveying direction of the sheet S. The shielding plate 37 shields the reception of light from a range other than a predetermined range centered on a position where the light receiving element 34 is arranged. In addition, a shielding plate 35, which shields light emitted from the light emitting elements 31, 32, and 33, is provided between the lower housing 95*b* and the conveyance path 39 to be substantially parallel to the conveying direction of the sheet S, and the reference plate 36 applied in green is provided on an upper surface of the shielding plate 35. The shielding plate 35 shields the reception of light from a range other than a predetermined range centered on a position where the light receiving element 34 is arranged. The shielding plate 37 and the shielding plate 35 shield light from a light source other than the light emitting elements 31, 32, and 33.

Here, the reference plate 36 is used when the intensity of reflection light that has been emitted from the light emitting element 33 and reflected on the sheet S is compared with the intensity of reflection light that has been emitted from the light emitting element 33 and reflected on the reference plate 36 when the sheet S does not exist on the conveyance path 39.

The light emitting element is, for example, a light emitting diode or the like, and the light receiving element is, for example, a phototransistor, a photodiode, or the like.

In addition, the medium sensor 95 is provided with a drive circuit 95*c*. The drive circuit 95*c* receives designation of a light emission timing and a light emission time for each light emitting element from the controller 100 in accordance with a timing at which the sheet S passes through the conveyance path 39, and controls the light emitting elements 31, 32, and 33 such that the light emitting elements 31, 32, and 33 emit light for the designated light emission time at the designated timing.

The light emitting elements 31, 32, and 33 emit light for the designated light emission time at the timing designated by the controller 100 under the control of the drive circuit 95*c*.

In addition, when the light receiving element 34 receives transmission light that has transmitted through the sheet S or the reflection light reflected on the surface of the sheet S or the reference plate 36 by the light emission of the light emitting elements 31, 32, and 33, the drive circuit 95*c* receives a signal indicating the intensity of the received transmission light or reflection light from the light receiving element 34. The drive circuit 95*c* amplifies and digitally converts the received signal, and outputs the converted signal to the controller 100.

The light emitting element 33 is used for determination of smooth paper (coated paper), and the light emitting elements 31 and 32 are used for determination of embossed paper as will be described later.

(5) Controller 100

The controller 100 includes a central processing unit (CPU) 101, a read only memory (ROM) 102, a random access memory (RAM) 103, and the like (FIG. 2).

The ROM 102 and the RAM 103 are formed by, for example, a nonvolatile semiconductor memory (so-called flash memory).

The ROM 102 stores a control computer program used in the image forming apparatus 1.

The RAM 103 provides the CPU 101 with a work area.

As the CPU 101 operates according to a program stored in the ROM 102, the controller 100 performs its function.

For example, the controller 100 controls operations of the blocks included in the image forming apparatus 1 in a unified manner.

The controller 100 receives various instructions from the operation part 22. The instruction received from the operation part 22 includes a print instruction of input image data stored in the image memory 80 (a copy job instruction).

The controller 100 determines whether the instruction received from operation part 22 is the print instruction for input image data.

When determining that the received instruction is an instruction other than the print instruction, the controller 100 performs processing according to the received instruction.

(a) Determination of Medium Type

The controller 100 designates light emission times at different timings for the light emitting elements 31, 32, and 33, respectively, in accordance with the timing at which the sheet S passes through the conveyance path 39 (FIG. 4), and controls the drive circuit 95*c* included in the medium sensor 95 such that the light emitting elements 31, 32, and 33 emit light.

In addition, the controller 100 designates the light emission time for the light emitting element 33 in accordance with a timing at which the sheet S does not exist in the conveyance path 39, and controls the drive circuit 95*c* of the medium sensor 95 such that the light emitting element 33 emits light.

In addition, the controller 100 receives a signal indicating the intensity of received light from the drive circuit 95*c* included in the medium sensor 95 at each of the timings described above.

(Determination of Smooth Paper)

As described above, the controller 100 causes the light emitting element 33 to emit light in accordance with the timing at which the sheet S does not exist in the conveyance path 39, and receives a first intensity of light from the drive circuit 95*c*. In addition, the controller 100 causes the light emitting element 33 to emit light in accordance with the timing at which the sheet S passes through the conveyance path 39, and receives a second intensity of light from the drive circuit 95*c*.

Next, the controller 100 calculates an intensity ratio of the second intensity relative to the first intensity.

Intensity Ratio=Second Intensity/First Intensity

Next, the controller 100 compares the calculated intensity ratio with a first threshold. If the intensity ratio is equal to or higher than the first threshold, the controller 100 determines that a medium type of the sheet S is smooth paper. If the intensity ratio is lower than the first threshold, it is determined that the medium type of the sheet S is not the smooth paper.

The intensity ratio is a reflectance of light that has been emitted from the light emitting element 33, reflected on the sheet S, and received by the light receiving element 34. The higher the reflectance is, the higher the smoothness of the surface of the sheet S is. The lower the reflectance is, the lower the smoothness of the surface of the sheet S is. Thus, it is possible to determine whether the sheet is the smooth paper by comparing the intensity ratio with the first threshold.

Here, the first threshold is, for example, 0.5. The first threshold depends on a light emission intensity of the light emitting element 33, a light reception sensitivity of the light receiving element 34, a distance between the light emitting element 33 and the sheet S, a distance between the sheet S and the light receiving element 34, and the like.

As described above, the controller 100 constitutes a determination unit that determines whether the type of the sheet is the smooth paper based on the intensity of the reflection light.

In addition, the determination unit of the controller 100 and the medium sensor 95 constitute a detector that detects the type of the sheet.

(Determination of Embossed Paper)

The controller 100 causes the light emitting element 31 to emit light when the sheet S exists in the conveyance path 39 (at a first position), and receives a third intensity of light from the drive circuit 95*c*. In addition, the controller 100 causes the light emitting element 32 to emit light at a timing different from the timing at which the light emitting element 31 emits light, and receives a fourth intensity of light from the drive circuit 95*c*.

In addition, the controller 100 causes the light emitting element 31 to emit light in the same manner as described above when the sheet S exists in the conveyance path 39 (has moved from the first position to a second position), and receives a fifth intensity of light from the drive circuit 95*c*. In addition, the controller 100 causes the light emitting element 32 to emit light at a timing different from the timing at which the light emitting element 31 emits light, and receives a sixth intensity of light from the drive circuit 95*c*.

Further, the controller 100 causes the light emitting element 31 to emit light in the same manner as described above when the sheet S exists in the conveyance path 39 (has moved from the second position to a third position), and receives a seventh intensity of light from the drive circuit 95*c*. In addition, the controller 100 causes the light emitting element 32 to emit light at a timing different from the timing at which the light emitting element 31 emits light, and receives an eighth intensity of light from the drive circuit 95*c*.

Hereinafter, when the sheet S moves in the conveyance path 39, the controller 100 receives a plurality of light intensities xi (i=1, 2, . . . , and n) at a plurality of positions on the sheet S in the same manner from the drive circuit 95*c*.

Next, the controller 100 calculates a variance v of the plurality of light intensities xi (i=1, 2, . . . , and n) by the following formula.

$$v = \frac{1}{n}\sum_{i=1}^{n}(x_i - m)^2 \quad \text{[Formula 1]}$$

Here, m is an average of the plurality of light intensities xi (i=1, 2, . . . , and n), and n is the number of measured light intensities.

Next, the controller 100 compares the calculated variance v with a second threshold. If the variance v is equal to or larger than the second threshold, the controller 100 determines that a medium type of the sheet S is embossed paper. If the variance v is smaller than the second threshold, it is determined that the medium type of the sheet S is not the embossed paper.

The surface of the embossed paper has irregularities at irregular positions, and the thickness of the surface is not uniform between the positions where the irregularities exist and positions where the irregularities do not exist. Thus, the intensity of transmission light at a plurality of positions on the surface of a sheet may be measured to obtain a variance v thereof, and it may be determined that the sheet is embossed paper when the variance v is large, that is, when the variance v is equal to or larger than the second threshold.

As described above, the controller 100 constitutes the determination unit that determines whether the type of the sheet is the embossed paper based on the plurality of intensities of transmission light.

In addition, the determination unit of the controller 100 and the medium sensor 95 constitute a detector that detects the type of the sheet.

In the above description, both the light emitting element 31 and the light emitting element 32 of the medium sensor 95 emit blue light of the same wavelength, and the intensity of light, which has been emitted by each of the light emitting element 31 and the light emitting element 32 and transmitted through the sheet S, is used for the determination of embossed paper. However, the embodiment is not limited to such a configuration. For example, the following configuration may be adopted.

The light emitting element 31 of the medium sensor 95 may emit, for example, blue light (whose wavelength is, for example, 470 nm), and the light emitting element 32 may emit, for example, near-infrared light (whose wavelength is, for example, 800 nm to 2600 nm). For example, the light emitting element 31 is used for the determination of embossed paper, and the light emitting element 32 is used for determination of other types of sheets.

In the determination of embossed paper, the controller 100 causes the light emitting element 31 to emit light when a plurality of locations on the sheet S are positioned within an irradiation range of blue light using the light emitting element 31 while conveying the sheet S in the conveyance path 39, and receives the intensity of transmission light from the drive circuit 95*c* at each light emission. In this manner, the controller 100 receives the intensities of transmission light at the plurality of locations on the sheet S. Next, the controller 100 calculates a variance v of the plurality of received intensities of transmission light as described above, and compares the calculated variance v with the second threshold to determine whether the sheet S is the embossed paper.

(b) Print (Image Formation) Control

When determining that an instruction is a print instruction, the controller 100 forms an image on a sheet S as will be described later.

The controller 100 causes the image reader 10 to acquire input image data by reading an image and write the acquired input image data in the image memory 80 in response to user's operation. Note that the controller 100 may cause the communication part 70 to acquire input image data through reception from the outside, and write the acquired input image data in the image memory 80.

When the input image data is acquired, the controller 100 causes the feeder 51 to feed the sheet S toward the conveyance path part 53. As described above, the controller 100 acquires a medium type of the sheet S that has passed through the conveyance path part 53 by controlling the medium sensor 95.

When the input image data is acquired, the controller 100 causes the image analyzer 45 to acquire a type of the image (that is, an image attribute and a color attribute) from the input image data written in the image memory 80.

(Case Where Medium Type Is Smooth Paper)

In the case where a medium type is smooth paper, the controller 100 selects the number-of-fixations table 200 shown in FIG. 3A.

The controller 100 determines the number of fixations using the acquired image attribute and color attribute and the selected number-of-fixations table 200 as will be described later. Here, the number of fixations is the number of times of causing the sheet S to pass through the fixing nip NP of the fixer 60. The number of fixations is either once or twice.

The controller 100 (a type determination unit) determines whether the image attribute indicates the first area. Next, the controller 100 determines whether the color attribute indicates that the area includes only the single reproduced color. The controller 100 may include a first determination unit that determines whether a partial image having a predetermined size or more in which all pixels have pixel values is included in an image of input image data, and a second determination unit that determines whether the partial image includes a superimposition of two or more reproduced colors.

If the image attribute indicates that an area is not the first area according to the number-of-fixations table 200, the controller 100 determines that the number of fixations is once regardless of the color attribute.

In addition, the controller 100 also determines that the number of fixations is once when the image attribute indicates that an area is the first area according to the number-of-fixations table 200 and the color attribute indicates that the area includes only the single reproduced color.

Further, the controller 100 determines that the number of fixations is twice when the image attribute indicates that an area is the first area according to the number-of-fixations table 200 and the color attribute indicates that the area includes the superimposition of two or more reproduced colors.

The controller 100 and the sheet guide member 56 switch to the first control when it is determined that the type of the sheet is the smooth paper and the partial image is not included in the image. In addition, the controller 100 and the sheet guide member 56 switch to the first control when it is determined that the type of the sheet is the smooth paper and the partial image does not include the superimposition of two or more reproduced colors. On the other hand, the controller 100 and the sheet guide member 56 switch to the second control when it is determined that the type of the sheet is the smooth paper and the partial image includes the superimposition of two or more reproduced colors.

After the sheet is re-fed to the fixer 60 by the second control, the controller 100 switches to the first control to discharge the sheet that has passed the fixer 60 toward the discharger 52 which is the discharge destination.

(Case Where Medium Type Is Embossed Paper)

In the case where a medium type is embossed paper, the controller 100 selects the number-of-fixations table 210 shown in FIG. 3B.

The controller 100 determines the number of fixations using the acquired image attribute and color attribute and the selected number-of-fixations table 210 as will be described later. The number of fixations is either twice or three times.

The controller 100 (a type determination unit) determines whether the image attribute indicates the first area. Next, the controller 100 determines whether the color attribute indicates that the area includes only the single reproduced color.

In other words, the controller 100 may include the first determination unit that determines whether a partial image having a predetermined size or more in which all pixels have pixel values is included in an image of input image data, and the second determination unit that determines whether the partial image includes a superimposition of two or more reproduced colors.

If the image attribute indicates that an area is not the first area according to the number-of-fixations table 210, the controller 100 determines that the number of fixations is twice regardless of the color attribute.

In addition, the controller 100 also determines that the number of fixations is twice when the image attribute indicates that an area is the first area according to the number-of-fixations table 210 and the color attribute indicates that the area includes only the single reproduced color.

Further, the controller 100 determines that the number of fixations is three times when the image attribute indicates that an area is the first area according to the number-of-fixations table 210 and the color attribute indicates that the area includes the superimposition of two or more reproduced colors.

In other words, the controller 100 and the sheet guide member 56 switch to the second control when it is determined that the type of the sheet is the embossed paper and the partial image is not included in the image. In addition, the controller 100 and the sheet guide member 56 switch to the second control when it is determined that the type of the sheet is the embossed paper and the partial image does not include the superimposition of two or more reproduced colors. On the other hand, the controller 100 and the sheet guide member 56 repeat the second control a plurality of times when it is determined that the type of the sheet is the embossed paper and the partial image includes the superimposition of two or more reproduced colors.

The controller 100 may switch to the first control to discharge the sheet that has passed the fixer 60 toward the discharger 52, which is the discharge destination, after the sheet is re-fed to the fixer 60 by the final second control among the plurality of times of repeated second control.

(Case Where Number of Fixations Is Once)

When determining that the number of fixations is once, the controller 100 causes the image forming part 40 to form a toner image, to transfer the formed toner image to the intermediate transfer belt 421, and then, to transfer the toner image to the sheet S via the secondary transfer rollers 424A and 424B. Next, the controller 100 causes the sheet S on which the toner image has been secondarily transferred to pass through the fixing nip NP of the fixer 60, thereby fixing the toner image onto the sheet S. Next, the controller 100 causes the discharger 52 to discharge the sheet S outside the apparatus. As a result, the image forming apparatus 1 ends the image formation on the sheet S.

(Case Where Number of Fixations Is Twice)

When determining that the number of fixations is twice, the controller 100 causes the image forming part 40 to form the toner image, to transfer the formed toner image to the intermediate transfer belt 421, and then, to transfer the toner image to the sheet S via the secondary transfer rollers 424A and 424B. Next, the controller 100 causes the sheet S on which the toner image has been secondarily transferred to pass through the fixing nip NP of the fixer 60.

Next, the controller 100 causes the sheet guide member 56 to convey the sheet S, which has completed the first fixation of the toner image in the fixer 60, toward the sheet guide member 73 on the lower side. Next, the controller 100 causes the sheet guide member 73 to convey the sheet S having been conveyed to the sheet guide member 73 toward the conveyance path 72, and to convey the sheet S from the conveyance path 72 to the conveyance path part 53.

Next, the controller 100 conveys the sheet S to the fixer 60 without transferring a toner image in the image forming part 40. Next, the controller 100 causes the sheet S to pass through the fixing nip NP of the fixer 60, thereby fixing the toner image on the sheet S. Next, the controller 100 causes the discharger 52 to discharge the sheet S outside the apparatus. As a result, the image forming apparatus 1 ends the image formation on the sheet S.

(Case Where Number of Fixations Is Three Times)

When determining that the number of fixations is three times, the controller 100 causes the image forming part 40 to form the toner image, to transfer the formed toner image to the intermediate transfer belt 421, and then, to transfer the toner image to the sheet S via the secondary transfer rollers 424A and 424B. Next, the controller 100 causes the sheet S on which the toner image has been secondarily transferred to pass through the fixing nip NP of the fixer 60.

Next, the controller 100 causes the sheet guide member 56 to convey the sheet S, which has completed the first fixation of the toner image in the fixer 60, toward the sheet guide member 73 on the lower side. Next, the controller 100 causes the sheet guide member 73 to convey the sheet S having been conveyed to the sheet guide member 73 toward the conveyance path 72, and to convey the sheet S from the conveyance path 72 to the conveyance path part 53.

Next, the controller 100 conveys the sheet S to the fixer 60 without transferring a toner image in the image forming part 40. Next, the controller 100 causes the sheet S to pass through the fixing nip NP of the fixer 60, thereby fixing the toner image on the sheet S.

Next, the controller 100 causes the sheet guide member 56 to convey the sheet S, which has completed the second fixation of the toner image in the fixer 60, toward the sheet guide member 73 on the lower side. Next, the controller 100 causes the sheet guide member 73 to convey the sheet S having been conveyed to the sheet guide member 73 toward the conveyance path 72, and to convey the sheet S from the conveyance path 72 to the conveyance path part 53.

Next, the controller 100 conveys the sheet S to the fixer 60 without transferring a toner image in the image forming part 40. Next, the controller 100 causes the sheet S to pass through the fixing nip NP of the fixer 60, thereby fixing the toner image on the sheet S.

Next, the controller 100 causes the discharger 52 to discharge the sheet S outside the apparatus. As a result, the image forming apparatus 1 ends the image formation on the sheet S.

1.4 Operation in Image Forming Apparatus 1

Figure 5:
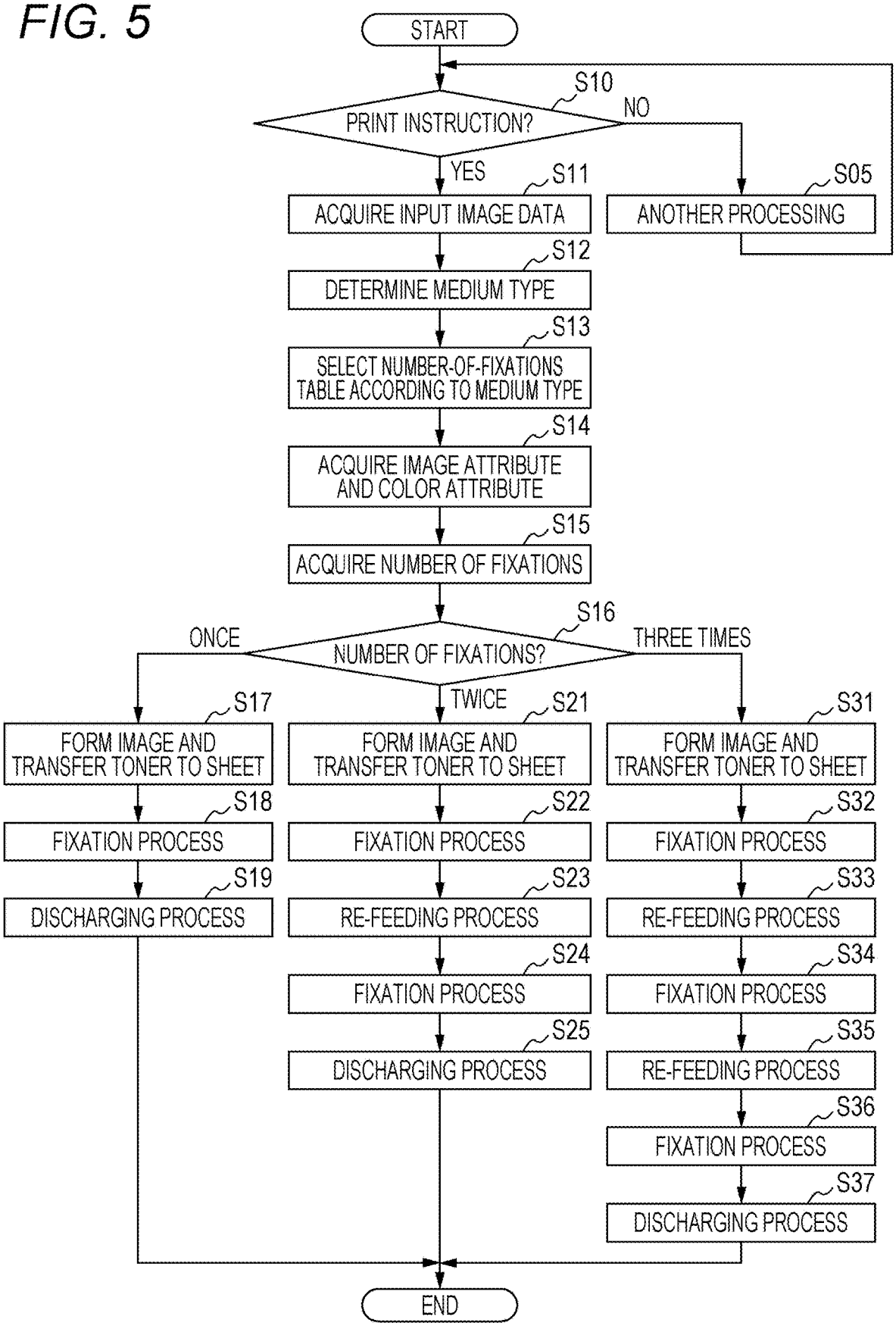
FIG. 5 is a flowchart showing a printing operation in the image forming apparatus.

An image formation operation in the image forming apparatus 1 will be described with reference to a flowchart shown in FIG. 5.

The controller 100 determines whether an instruction received from operation part 22 is a print instruction for input image data (Step S10).

When determining that the instruction is an instruction other than the print instruction ("NO" in Step S10), the controller 100 performs processing according to the received instruction (Step S05), and then, returns control to Step S10 to repeat the processing.

When determining that the instruction is the print instruction ("YES" in Step S10), the controller 100 causes the image reader 10 to acquire input image data by image reading, and writes the acquired input image data in the image memory 80 (Step S11).

Next, the controller 100 causes the feeder 51 to feed the sheet S toward the conveyance path part 53, and controls the medium sensor 95 to determine a medium type of the sheet S that has passed through the conveyance path part 53 (Step S12).

Next, the controller 100 selects a number-of-fixations table according to the medium type (Step S13).

Next, the controller 100 causes the image analyzer 45 to acquire an image attribute and a color attribute from the input image data written in the image memory 80 (Step S14).

Next, the controller 100 acquires the number of fixations using the acquired image attribute and color attribute and the selected number-of-fixations table (Step S15).

If the number of fixations is once ("once" in Step S16), the controller 100 causes the image forming part 40 to form a toner image, to transfer the formed toner image to the intermediate transfer belt 421, and then, to transfer the toner image to the sheet S via the secondary transfer rollers 424A and 424B (Step S17). Next, the controller 100 causes the sheet S on which the toner image has been secondarily transferred to pass through the fixing nip NP of the fixer 60, thereby fixing the toner image onto the sheet S (Step S18). Next, the controller 100 causes the discharger 52 to discharge the sheet S outside the apparatus (Step S19). As a result, the image forming apparatus 1 ends the image formation on the sheet S.

If the number of fixations is twice ("twice" in Step S16), the controller 100 causes the image forming part 40 to form a toner image, to transfer the formed toner image to the intermediate transfer belt 421, and then, to transfer the toner image to the sheet S via the secondary transfer rollers 424A and 424B (Step S21). Next, the controller 100 causes the sheet S on which the toner image has been secondarily transferred to pass through the fixing nip NP of the fixer 60 (Step S22).

Next, the controller 100 causes the sheet guide member 56 to convey the sheet S, which has completed the first fixation of the toner image in the fixer 60, toward the sheet guide member 73 on the lower side via the conveyance path 74. Next, the controller 100 causes the sheet guide member 73 to convey the sheet S having been conveyed to the sheet guide member 73 toward the conveyance path 72, and to convey the sheet S from the conveyance path 72 to the conveyance path part 53 again. The controller 100 conveys the sheet S to the fixer 60 without transferring a toner image in the image forming part 40 (Step S23). Next, the controller 100 causes the sheet S to pass through the fixing nip NP of the fixer 60, thereby fixing the toner image on the sheet S (Step S24). Next, the controller 100 causes the discharger 52 to discharge the sheet S outside the apparatus (Step S25). As a result, the image forming apparatus 1 ends the image formation on the sheet S.

If the number of fixations is three times ("three times" in Step S16), the controller 100 causes the image forming part 40 to form a toner image, to transfer the formed toner image to the intermediate transfer belt 421, and then, to transfer the toner image to the sheet S via the secondary transfer rollers 424A and 424B (Step S31). Next, the controller 100 causes the sheet S on which the toner image has been secondarily transferred to pass through the fixing nip NP of the fixer 60 (Step S32).

Next, the controller 100 causes the sheet S having completed the first fixation of the toner image in the fixer 60 to be conveyed again to the conveyance path part 53 via the conveyance path 74 and the conveyance path 72. The controller 100 conveys the sheet S to the fixer 60 without transferring a toner image in the image forming part 40 (Step S33). Next, the controller 100 causes the sheet S to pass through the fixing nip NP of the fixer 60, thereby fixing the toner image on the sheet S (Step S34).

Next, the controller 100 causes the sheet S having completed the second fixation of the toner image in the fixer 60 to be conveyed again to the conveyance path part 53 via the conveyance path 74 and the conveyance path 72. The controller 100 conveys the sheet S to the fixer 60 without transferring a toner image in the image forming part 40 (Step S35). Next, the controller 100 causes the sheet S to pass through the fixing nip NP of the fixer 60, thereby fixing the toner image on the sheet S (Step S36).

Next, the controller 100 causes the discharger 52 to discharge the sheet S outside the apparatus (Step S37). As a result, the image forming apparatus 1 ends the image formation on the sheet S.

1.5 Summary

It is preferable to cause the smooth paper having the smooth surface, such as coated paper, to pass through the fixer a plurality of times since the gloss unevenness is likely to be conspicuous in an image after the fixation. However, the gloss unevenness is less likely to be conspicuous in a case where an image attribute of an image to be printed indicates the second area (for example, including an image such as a character image) or a case where a color attribute indicates that the area includes only the single reproduced color. Therefore, in such a case, it is possible to secure the productivity of printing while maintaining the image quality by reducing the number of fixations.

In addition, it is preferable to cause the embossed paper to pass through the fixer a plurality of times since a poor fixation of toner particles, transferred to a groove bottom of a recess on the surface, is likely to occur. However, the poor fixation of toner particles is less likely to occur in a case where an image attribute of an image to be printed indicates the second area or a case where a color attribute indicates that the area includes only the single reproduced color. Therefore, in such a case, it is possible to secure the productivity of printing while maintaining the image quality by reducing the number of fixations.

According to the above-described embodiment, an excellent effect that an appropriate amount of heat can be applied to the sheet is achieved when fixing the toner image onto the sheet.

1.6 Example (1)

Example (1) of the above embodiment will be described hereinafter.

When a plurality of sheets are successively printed as one print job, the number of times of passing through the fixer differs depending on the sheet in some cases. For example, there is a case where the number of times that a first sheet passes through the fixer is twice, and the number of times that a second sheet passes through the fixer is once.

Figure 6A:
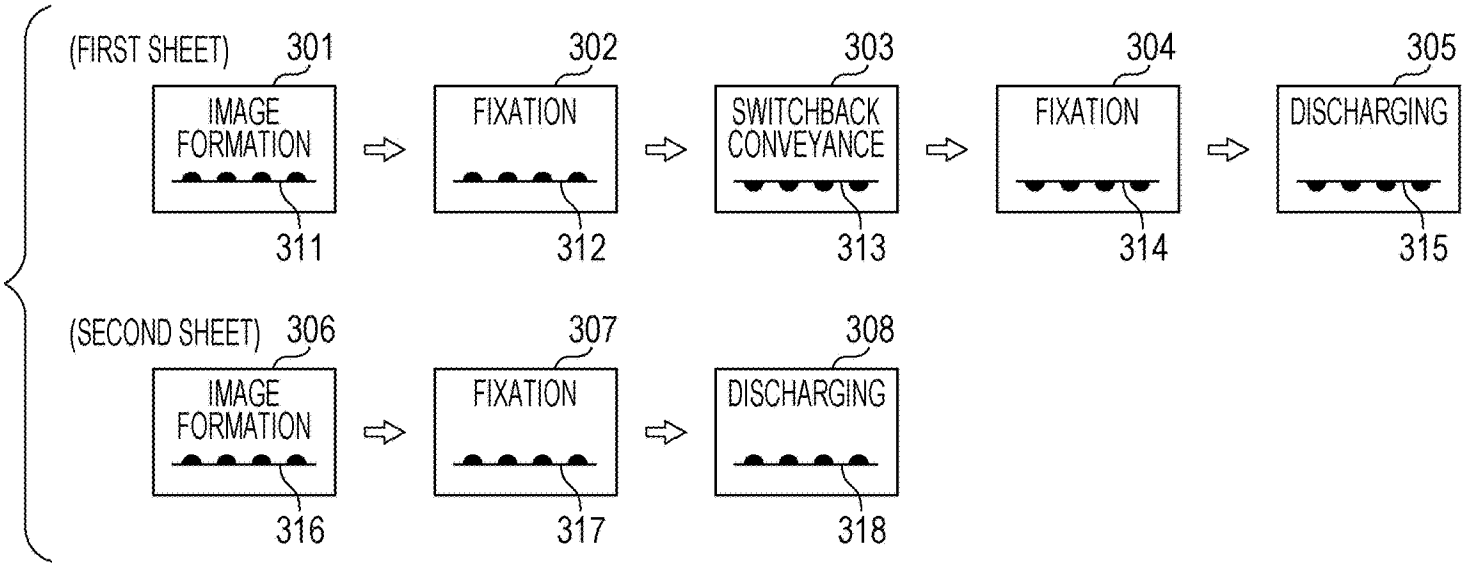
FIG. 6A is a view showing processes of single-side printing of two sheets in the image forming apparatus, one process of which includes switchback conveyance.

In such a case, a toner image is formed on a sheet 311 by image formation (301) for the first sheet, and the toner image is fixed onto a sheet 312 by a fixation (302) as shown in FIG. 6A. Next, a reversed sheet 313 is conveyed by switchback conveyance (303) using the re-feeding reversal roller 71 and the sheet guide member 73, and a sheet 314 is caused to pass through the fixer 60 again by a fixation (304). Finally, a sheet 315 is discharged (305).

On the other hand, for the second sheet, a toner image is formed on a sheet 316 by image formation (306), the toner image is fixed onto a sheet 317 by a fixation (307), and a sheet 318 is discharged (308).

When two sheets are successively printed as one print job in this manner, there occurs a problem that the orientation of a printed surface of the discharged first sheet 315 (facing down) differs from the orientation of a printed surface of the discharged second sheet 318 (facing up).

Figure 6B:
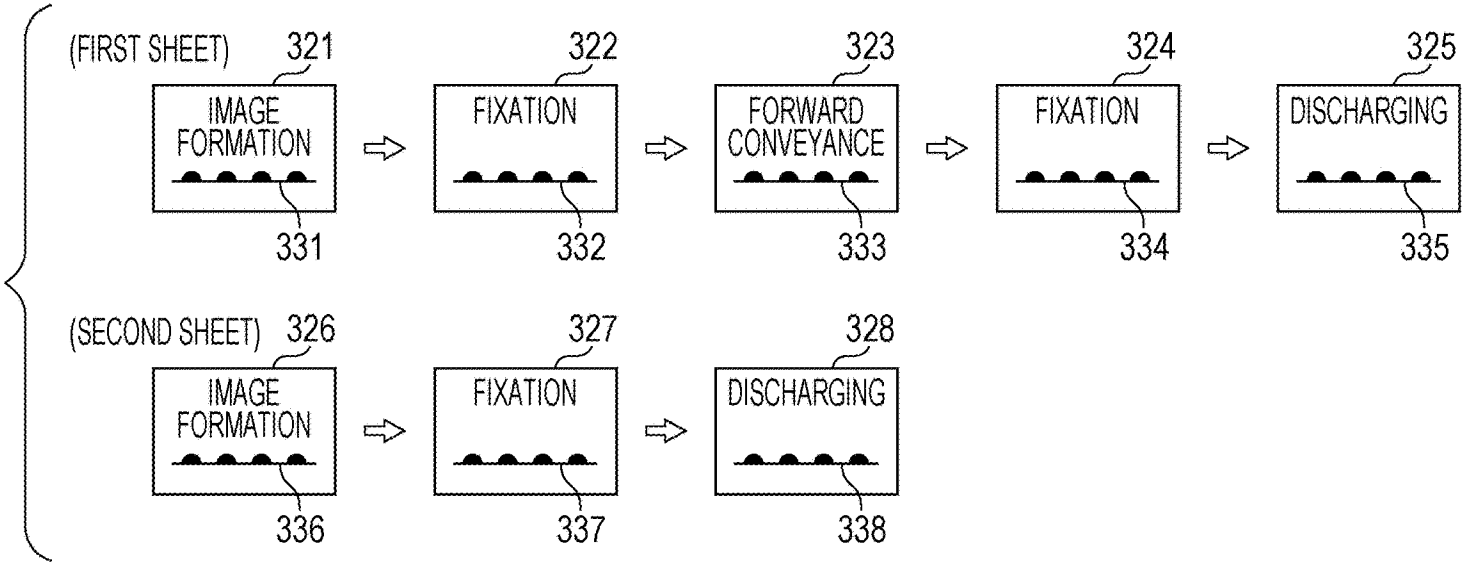
FIG. 6B is a view showing processes of single-side printing of two sheets in the image forming apparatus, one process of which includes sequential conveyance.

In order to solve this problem, a toner image is formed on a sheet 331 by image formation (321) for the first sheet, and the toner image is fixed onto a sheet 332 by a fixation (322) as shown in FIG. 6B. Next, a sheet 333 with the orientation being kept is conveyed by forward conveyance (323) using the sheet guide member 73, and a sheet 334 is caused to pass through the fixer 60 again by a fixation (324). Finally, the sheet 335 is discharged (325).

On the other hand, for the second sheet, a toner image is formed on a sheet 336 by image formation (326), the toner image is fixed onto a sheet 337 by a fixation (327), and a sheet 338 is discharged (328).

When two sheets are successively printed as one print job in this manner, the orientation of a printed surface of the discharged first sheet 335 and the orientation of a printed surface of the discharged second sheet 338 can be made consistent.

As described above, the sheet guide member 73, which switches between the re-feeding path (the conveyance paths 74 and 72) that can re-feed a sheet with the leading end being kept and the re-feeding path (the conveyance paths 74, 75, and 72) that can re-feed a sheet with the leading end being switched, may be provided such that the re-feeding path is selectively used depending on the number of fixations for each sheet and whether the printed surface is one side or both sides in order to correctly align the order of pages after discharging while suppressing a decrease in productivity of printing as much as possible when the plurality of sheets are successively printed as one print job and the number of times of passing through the fixer differs depending on the sheet.

In other words, the re-feeder 57, which is the re-feeding path, may include a reversal conveyance path (the conveyance paths 74, 75, and 72) that reverses the conveying direction of the sheet having passed through the fixer 60 to be guided toward the fixer 60, and a normal conveyance path (the conveyance paths 74 and 72) that guides the sheet toward the fixer 60 while maintaining the conveying direction of the sheet having passed through the fixer 60.

When switching to the second control, the controller 100 and the sheet guide member 56 may select the normal conveyance path of the reversal conveyance path and the normal conveyance path depending on an image type and a sheet type or depending on whether a printed surface is one side or both sides.

1.7 Example (2)

Example (2) of the above embodiment will be described hereinafter.

When printing is performed on the front surface and the back surface of one sheet, there is a case where the number of times of passing through the fixer is twice for each surface.

Figure 7:
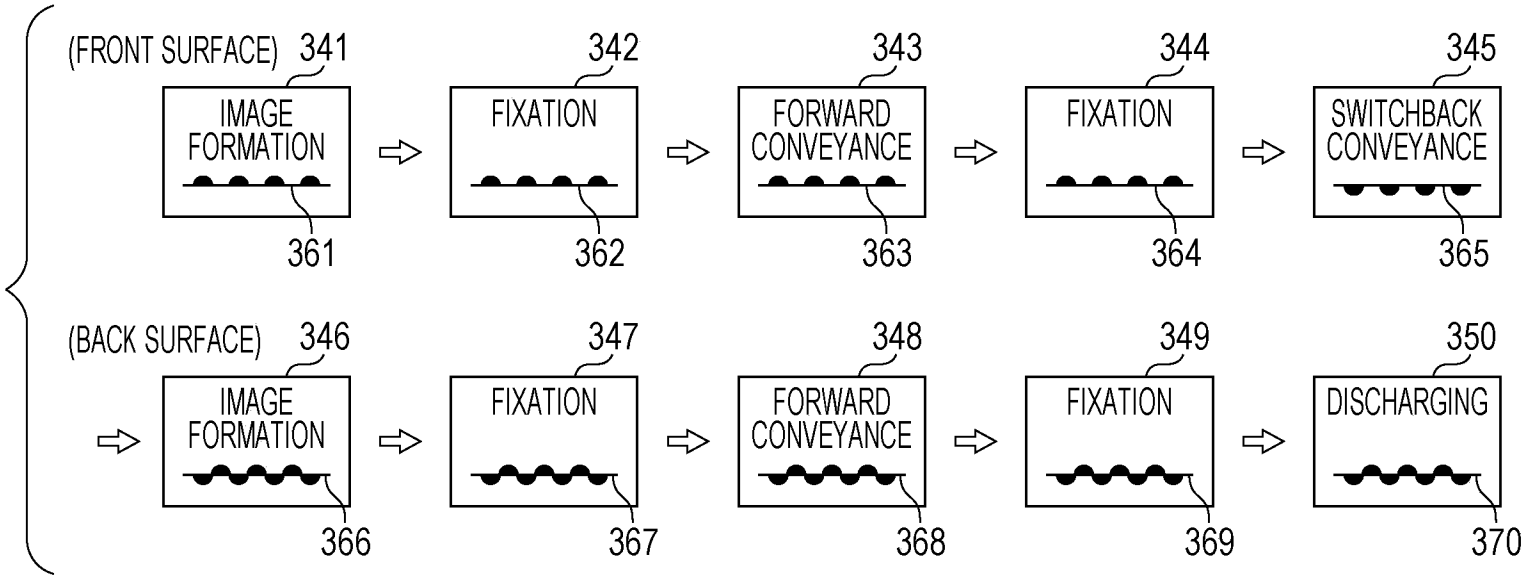
FIG. 7 is a view showing processes of double-sided printing of one sheet in the image forming apparatus.

In such a case, a toner image is formed on a sheet 361 by image formation (341) for the front surface of the sheet, and the toner image is fixed onto a sheet 362 by a fixation (342) as shown in FIG. 7. Next, a sheet 363 with the orientation being kept is conveyed by forward conveyance (343) using the sheet guide member 73, and a sheet 364 is caused to pass through the fixer 60 again by a fixation (344). Next, the reversed sheet 365 is conveyed by switchback conveyance (345) using the re-feeding reversal roller 71 and the sheet guide member 73.

Next, a toner image is formed on a sheet 366 by image formation (346) for the back surface of the sheet, and the toner image is fixed onto a sheet 367 by a fixation (347). Next, a sheet 368 with the orientation being kept is conveyed by forward conveyance (348) using the sheet guide member 73, and a sheet 369 is caused to pass through the fixer 60 again by a fixation (349). Finally, a sheet 370 is discharged (350).

In this manner, when the printing is performed on the front surface and the back surface of one sheet, each surface passes through the fixer 60 twice. In this case, one sheet passes through the fixer 60 four times in total.

Note that the fixation (344) shown in FIG. 7 may be omitted if the amount of heat applied to the toner image is sufficient. In this case, the forward conveyance (343) is also omitted.

1.8 Example (3)

Example (3) of the above embodiment will be described hereinafter.

Here, it is assumed that medium types of sheets accommodated in all the feeding tray units 51*a* to 51*c* have been acquired at the start of printing.

When two sheets are successively subjected to single-side printing as one print job, the number of times of passing through the fixer 60 differs depending on the sheet in some cases.

For example, there is a case where the number of times that a first sheet passes through the fixer 60 is once, and the number of times that a second sheet passes through the fixer 60 is twice. Such a fixing condition is formed, for example, when medium types of the sheets are smooth paper, image data of the first sheet includes a character image only, and image data of the second sheet includes a color (two or more reproduced colors) photographic image. In such a case, each process for the two sheets in the image forming apparatus 1 will be described with reference to FIG. 8.

Figure 8:
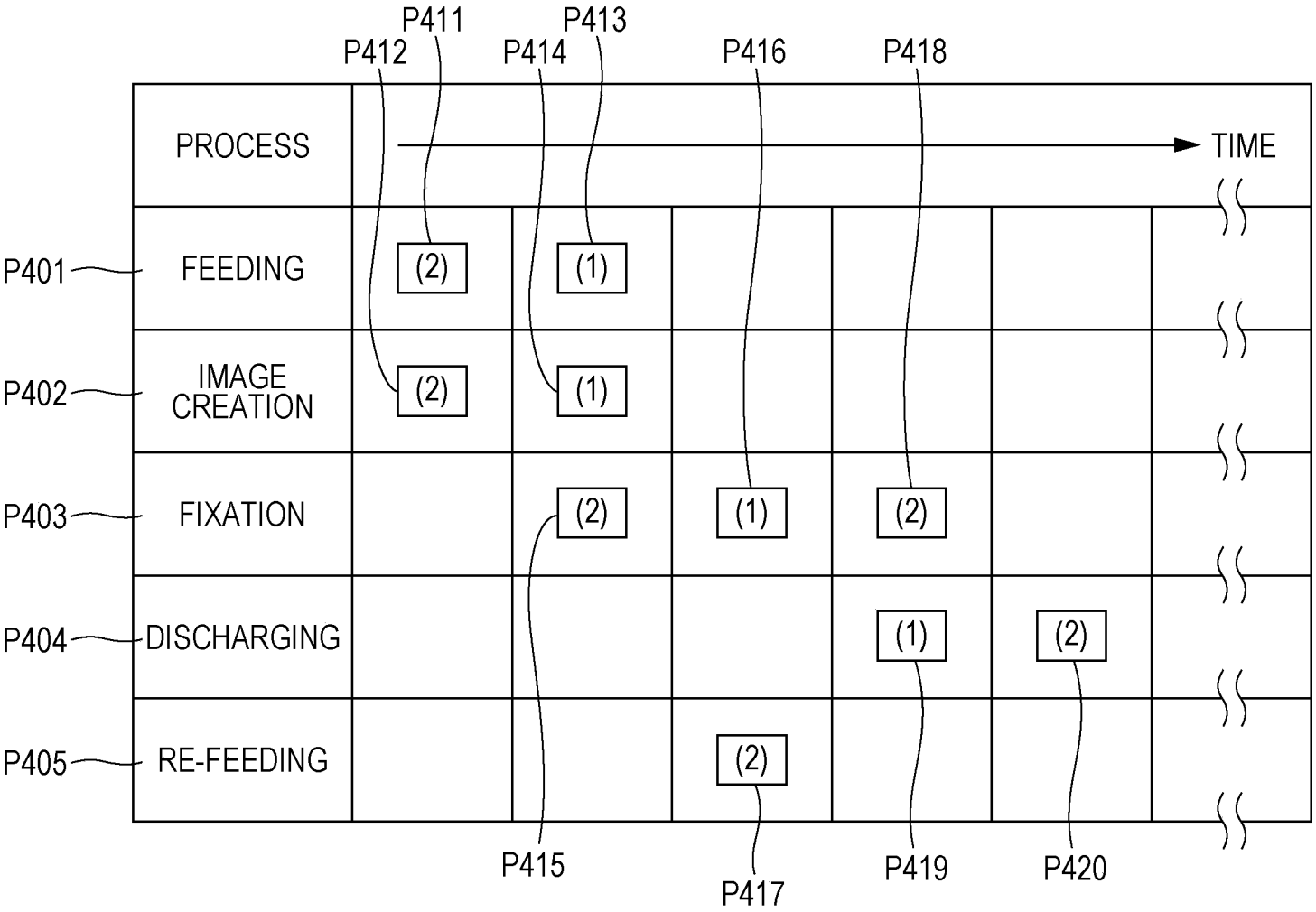
FIG. 8 is a time chart showing each process of the image forming apparatus with respect to two sheets on a time axis.

FIG. 8 is a time chart showing each process of the image forming apparatus 1 with respect to the two sheets on a time axis.

In FIG. 8, the vertical axis indicates feeding P401, image creation P402, a fixation P403, discharging P404, and re-feeding P405 as processes, and the horizontal axis indicates the passage of time from left to right on the paper surface. In FIG. 8, the block with the number "1" corresponds to one process for the first sheet, and the block with the number "2" corresponds to one process for the second sheet.

First, feeding (P411) and image creation (P412) of the second sheet are performed, and the second sheet is subjected to a fixation (P415) after the image creation (P412) of the second sheet. After the image creation (P412) of the second sheet, feeding (P413) and image creation (P414) of the first sheet are performed. After a fixation (P415) of the second sheet, the first sheet is subjected to a fixation (P416).

After the fixation (P415) of the second sheet, the second sheet is subjected to re-feeding (P417) to a re-feeding conveyance path (the re-feeder 57). The fixation (P416) of the first sheet and the re-feeding (P417) of the second sheet to the re-feeding conveyance path are performed in the same time slot.

After the fixation (P416) of the first sheet, the first sheet is subjected to discharging (P419), and the second sheet is subjected to a fixation (P418). After the fixation (P418) of the second sheet, the second sheet is subjected to discharging (P420).

In this manner, the second sheet is subjected to the discharging (P420) after the discharging (P419) of the first sheet, so that the order of the sheets is not changed.

In addition, the fixation (P416) of the first sheet is performed in the time slot when the re-feeding (P417) of the second sheet is performed for the second fixation after the first fixation (P415) of the second sheet, and thus, it is possible to minimize the suppress the decrease in productivity as much as possible.

Here, as a job reception part, the image reader 10 may form first and second toner images on the first and second sheets, respectively, and receive first and second jobs to discharge the first and second sheets in this order.

The controller 100 may execute sheet feeding, toner image formation, a toner image fixation, sheet discharging, and re-feeding to the re-feeding path for each of the jobs.

A type of the first image, which is a source of formation of the first toner image, and a type of the first sheet may satisfy a condition that the first sheet passes through the fixer 60 only once. A type of the second image, which is a source of formation of the second toner image, and a type of the second sheet may satisfy a condition that the second sheet passes through the fixer 60 twice.

The controller 100 may (a) execute feeding of the first sheet, formation of the first toner image, a fixation of the first toner image, and discharging of the first sheet by the first control, for the first job; (b) execute feeding of the second sheet, formation of the second toner image, a fixation of the second toner image, re-feeding of the second sheet to the re-feeder 57, which is the re-feeding path, by the second control, a re-fixation of the second toner image, and discharging of the second sheet, for the second job; (c) execute the feeding of the second sheet and the formation of the second toner image prior to the feeding of the first sheet and the formation of the first toner image; and (d) execute the fixation of the first toner image and the re-feeding of the second sheet to the re-feeder 57, which is the re-feeding path, in the same time slot.

1.9 Example (4)

Example (4) of the above embodiment will be described hereinafter.

Here, it is also assumed that medium types of sheets accommodated in all the feeding tray units 51*a* to 51*c* have been acquired at the start of printing.

When three sheets are successively subjected to single-side printing as one print job, the number of times of passing through the fixer 60 differs depending on the sheet in some cases.

For example, there is a case where the number of times that a first sheet passes through the fixer 60 is once, and the number of times that second and third sheets pass through the fixer 60 is twice. Such a fixing condition is formed, for example, when medium types of the sheets are smooth paper, image data of the first sheet includes a character image only, and image data of the second and third sheets includes a color (two or more reproduced colors) photographic image. In such a case, each process for the three sheets in the image forming apparatus 1 will be described with reference to FIG. 9.

Note that it is assumed that the re-feeder 57 of the image forming apparatus 1 can accommodate up to two sheets in one time slot.

Figure 9:
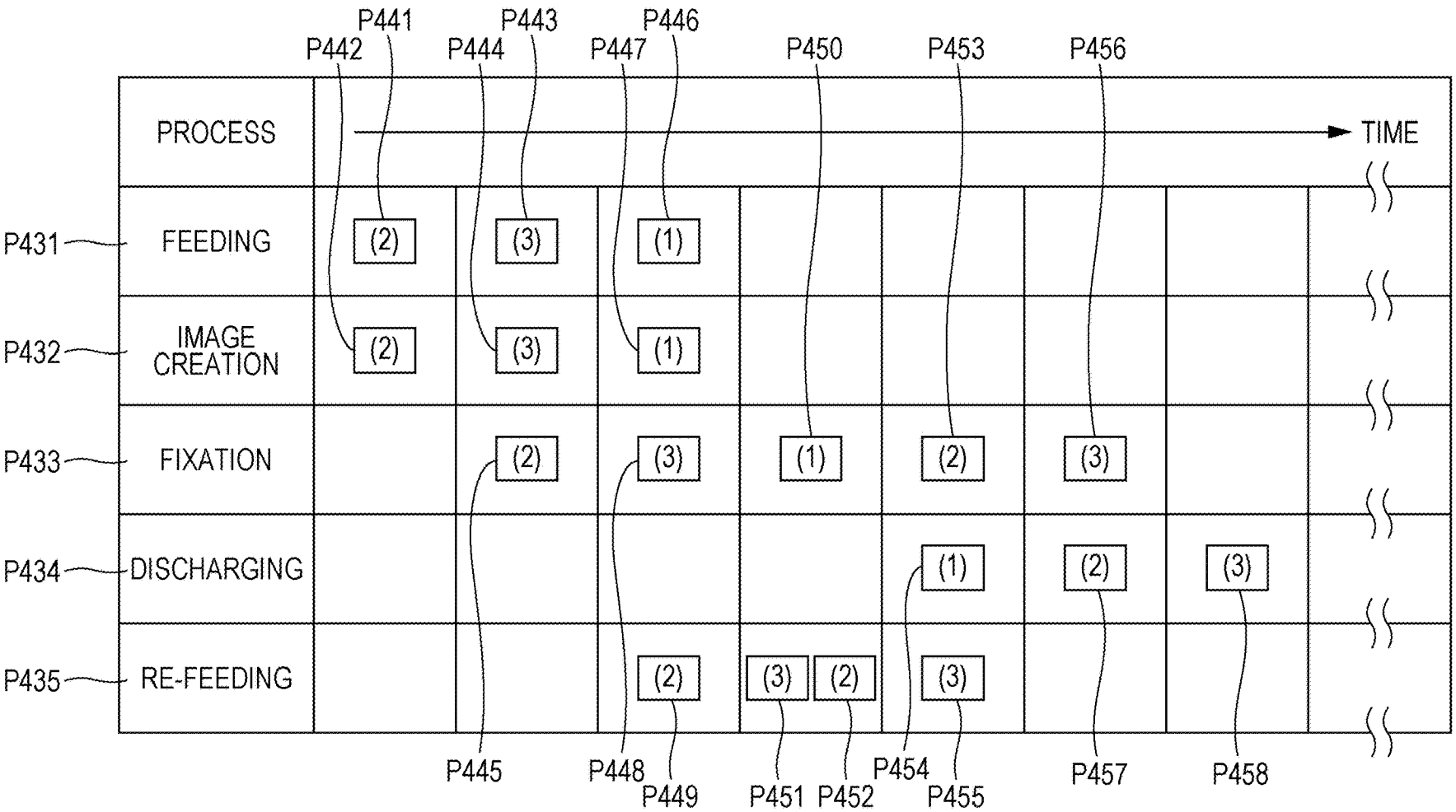
FIG. 9 is a time chart showing each process of the image forming apparatus with respect to three sheets on a time axis.

FIG. 9 is a time chart showing each process of the image forming apparatus 1 with respect to the three sheets on a time axis.

In FIG. 9, the vertical axis indicates feeding P431, image creation P432, a fixation P433, discharging P434, and re-feeding P435 as processes, and the horizontal axis indicates the passage of time from left to right on the paper surface. In FIG. 9, the block with the number "1" corresponds to one process for the first sheet, the block with the number "2" corresponds to one process for the second sheet, and the block with the number "3" corresponds to one process for the third sheet.

First, feeding (P441) and image creation (P442) of the second sheet are performed, and the second sheet is subjected to a fixation (P445) after the image creation (P442) of the second sheet. After the image creation (P442) of the second sheet, feeding (P443) and image creation (P444) of the third sheet are performed. After a fixation (P445) of the second sheet, the third sheet is subjected to a fixation (P448).

After the image creation (P444) of the third sheet, feeding (P446) and image creation (P447) of the first sheet are performed. After a fixation (P448) of the third sheet, the first sheet is subjected to a fixation (P450).

After the fixation (P445) of the second sheet, the second sheet is subjected to re-feeding (P449) to a re-feeding conveyance path (the re-feeder 57). The fixation (P448) of the third sheet and the re-feeding (P449) of the second sheet to the re-feeding conveyance path are performed in the same time slot.

After the fixation (P448) of the third sheet, the third sheet is subjected to re-feeding (P451) to a re-feeding conveyance path. In the re-feeding conveyance path, re-feeding (P452) of the second sheet and re-feeding (P451) of the third sheet are performed. The fixation (P450) of the first sheet and the re-feeding (P452) of the second sheet, and the re-feeding (P451) of the third sheet are performed in the same time slot.

After the fixation (P450) of the first sheet, the first sheet is subjected to discharging (P454), and second sheet is subjected to a fixation (P453), and the third sheet remains on the re-feeding conveyance path (P455). After the fixation (P453) of the second sheet, the second sheet is subjected to discharging (P457), and the third sheet is subjected to a fixation (P456). After the fixation (P456) of the third sheet, the third sheet is subjected to discharging (P458).

In this manner, the second sheet is subjected to the discharging (P457) after the discharging (P454) of the first sheet, and the third sheet is subjected to the discharging (P458) after the discharging (P457) of the second sheet, so that the order of the sheets is not changed.

In addition, the fixation (P450) of the first sheet is performed in the time slot when the second and third sheets are subjected to the re-feeding (P452 and P451) for the second fixation after the first fixation (P448) of the third sheet, and thus, it is possible to minimize the suppress the decrease in productivity as much as possible.

2 Other Modifications

The present invention has been described based on the above embodiment, but is not limited to the above embodiment. The following modifications may be made.

(1) The number of times that a sheet passes through the fixer 60 may be controlled depending on a type of an image without depending on a medium type of the sheet.

For example, the number of fixations of causing the passage through the fixer 60 may be set to once regardless of whether an area includes only the single reproduced color or a superimposition of two or more reproduced colors based on a color attribute (a) when an image attribute indicates that the area is not the first area (for example, a graphic image or a character image).

In addition, the number of fixations that causes the passage through the fixer 60 may be set to once (b) when the image attribute indicates that the area is the first area and the color attribute indicates that the area includes only the single reproduced color.

On the other hand, the number of fixations that causes the passage through the fixer 60 may be set to twice (c) when the image attribute indicates that the area is the first area and the color attribute indicates that the area includes the superimposition of two or more reproduced colors.

As described in the above embodiment, the controller 100 and the sheet guide member 56 constitute the switcher. Here, the controller 100 and the sheet guide member 56 may switch between the first control to discharge a sheet that has passed through the fixer 60 toward the discharger 52, which is the discharge destination, and the second control to re-feed the sheet that has passed through the fixer 60 to the fixer 60 through the re-feeder 57, which is a re-feeding path, depending on a type of an image.

In detail, the controller 100 may include the first determination unit that determines whether a partial image having a predetermined size or more in which all pixels have pixel values is included in the image, and the second determination unit that determines whether the partial image includes a superimposition of two or more reproduced colors. In addition, the controller 100 and the sheet guide member 56 may switch to the first control when it is determined that the partial image is not included in the image, switch to the first control when it is determined that the partial image does not include the superimposition of two or more reproduced colors, and switch to the second control when it is determined that the partial image includes the superimposition of two or more reproduced colors.

In recent years, there has been a demand for a higher sheet conveying speed in the image forming apparatus 1.

Since the amount of heat generated by the heating source 60C of the fixer 60 has an upper limit (for example, 1000 watts), the amount of heat applied to the sheet S in the fixer 60 relatively decreases if the sheet conveying speed in the image forming apparatus 1 is increased. Thus, the number of fixations of causing the passage through the fixer 60 is set to once in the cases of (a) and (b), and the number of fixations of causing the passage through the fixer 60 is set to twice in the case of (c).

With this configuration, a sufficient amount of heat can be applied to the sheet S even under the condition (c) when the sheet conveyance speed is increased, and it is possible to improve the fixing property of the toner image formed on the sheet S.

(2) In the above embodiment, the controller 100 controls the medium sensor 95 to calculate the variance of the plurality of intensities of transmission light at the plurality of locations on the sheet S, thereby determining whether the medium type of the sheet S is the embossed paper.

However, the embodiment is not limited to such a configuration.

The controller 100 may control the medium sensor 95 to acquire the surface roughness, basis weight, thickness, and the like of the sheet S at a plurality of locations on the sheet S, and calculate a variance of these values to determine whether the medium type of the sheet S is the embossed paper.

In addition, the selection of "embossed paper" in the print paper settings may be received from a user via the operation part 22 and the print paper settings may be stored. In this case, whether the medium type of the sheet S is the embossed paper may be determined based on the stored print paper settings.

(3) The image forming apparatus 1 may include a post-processing part that performs staple binding or punching on a plurality of sheets at a discharge destination of the fixer 60.

In addition, a post-processor that performs staple binding or punching on a plurality of sheets may be connected at a discharge destination of the fixer 60 in the image forming apparatus 1.

(4) As described above, the image forming apparatus is the computer system including the microprocessor and the memory. The memory stores a computer program, and the microprocessor operates according to the computer program.

The microprocessor includes a fetcher, a decoder, an executer, a register file, an instruction counter, and the like. The fetcher reads instruction codes included in the computer program one by one from the computer program stored in the memory. The decoder decodes the read instruction code. The executer operates according to the decoded result. Thus, the microprocessor operates according to the computer program stored in the memory.

Here, the computer program is formed by combining a plurality of instruction codes indicating instructions with respect to the computer in order to achieve a predetermined function.

In addition, the computer program may be recorded on a computer-readable recording medium, for example, a flexible disk, a hard disk, an optical disk, a semiconductor memory, or the like.

In addition, the computer program may be transmitted via a wired or wireless telecommunication line, a network represented by the Internet, data broadcasting, or the like.

(5) The above embodiment and the above modifications may be combined.

An image forming apparatus according to the present invention achieves an excellent effect that a toner image can be appropriately fixed onto a sheet depending on the toner image, and is advantageous as a technique for fixing a toner image transferred on a sheet to the sheet in an electrophotographic image forming apparatus.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus that fixes a toner image onto a sheet by a fixer, the image forming apparatus comprising:

a re-feeding path that normally conveys the sheet having passed through the fixer and guides the sheet toward the fixer;

a hardware processor that switches between first control to discharge the sheet having passed through the fixer toward a discharge destination and second control to re-feed the sheet having passed through the fixer to the fixer through the re-feeding path, depending on a type of an image which is a source of formation of the toner image; and an image acquisition part that acquires the image which is the source of formation of the toner image, wherein the hardware processor determines whether a partial image having a predetermined size of more in which all pixels have pixel values is included in the image, the hardware processor determines whether the partial image includes a superimposition of two or more reproduced colors, and the hardware processor switches to the first control when it is determined that the partial image is not included in the image, switches to the first control when it is determined that the partial image does not include the superimposition of two or more reproduced colors, and switched to the second control when it is determined that the partial image includes the superimposition of two or more reproduced colors.

2. An image forming apparatus that fixes a toner image onto a sheet by a fixer, the image forming apparatus comprising:

a re-feeding path that normally conveys the sheet having passed through the fixer and guides the sheet toward the fixer;

a hardware processor that switches between first control to discharge the sheet having passed through the fixer toward a discharge destination and second control to re-feed the sheet having passed through the fixer to the fixer through the re-feeding path, depending on a type of an image, which is a source of formation of the toner image, and a type of the sheet; and an image acquisition part that acquires an image which is a source of formation of the toner image, wherein the hardware processor further detects the type of the sheet, the hardware processor determines whether a partial image having a predetermined size or more in which all pixels have pixel values is included in the image, the hardware processor determines whether the partial image includes a superimposition or two or more reproduced colors, and the hardware processor switches to the first control when it is determined that the type of the sheet is the smooth paper and the partial image is not included in the image, switches to the first control when it is determined that the type of the sheet is the smooth paper and the partial image does not include the superimposition of two or more reproduced colors, and switches to the second control when it is determined that the type of the sheet is the smooth paper and the partial image includes the superimposition of two or more reproduced colors.

3. The image forming apparatus according to claim 2, wherein the hardware processor comprises:

a sensor that detects an intensity of light reflected on a surface of the sheet, and the hardware processor determines whether the type of the sheet is the smooth paper based on the detected intensity of light.

4. The image forming apparatus according to claim 2, wherein the hardware processor switches to the first control to discharge the sheet having passed through the fixer toward the discharge destination after the sheet is re-fed to the fixer by the second control.

5. The image forming apparatus according to claim 2, further comprising:

an image acquisition part that acquires an image which is a source of formation of the toner image, wherein the hardware processor determines whether a partial image having a predetermined size or more in which all pixels have pixel values is included in the image, the hardware processor determines whether the partial image includes a superimposition of two or more reproduced colors, and the hardware processor switches to the second control when it is determined that the type of the sheet is embossed paper and the partial image is not included in the image, switches to the second control when it is determined that the type of the sheet is the embossed paper and the partial image does not include the superimposition of two or more reproduced colors, and repeats the second control a plurality of times when it is determined that the type of the sheet is the embossed paper and the partial image includes the superimposition of two or more reproduced colors.

6. The image forming apparatus according to claim 5, wherein the hardware processor comprises:

a sensor that detects an intensity of transmission light at a plurality of locations on a surface of the sheet, and the hardware processor determines whether the type of the sheet is the embossed paper based on the plurality of detected intensities of transmission light.

7. The image forming apparatus according to claim 5, wherein the hardware processor switches to the first control to discharge the sheet having passed through the fixer toward the discharge destination after the sheet is re-fed to the fixer by final second control among the plurality of times of repeated second control.

8. The image forming apparatus according to claim 2, wherein the re-feeding path comprises: a reversal conveyance path that reverses a conveying direction of the sheet having passed through the fixer and guides the sheet toward the fixer; and a normal conveyance path that maintains the conveying direction of the sheet having passed through the fixer and guides the sheet toward the fixer, and when switching to the second control, the hardware processor selects the normal conveyance path of the reversal conveyance path and the normal conveyance path.

9. The image forming apparatus according to claim 2, further comprising:

a job reception part that forms first and second toner images on first and second sheets, respectively, and receives first and second jobs set to discharge the first and second sheets in this order, wherein the hardware processor executes sheet feeding, toner image formation, a toner image fixation, sheet discharging, and re-feeding to the re-feeding path for each of the jobs, a type of the first image, which is a source of formation of the first toner image, and a type of the first sheet satisfy a condition that the first sheet passes through the fixer only once, and a type of the second image, which is a source of formation of the second toner image, and a type of the second sheet satisfy a condition that the second sheet passes through the fixer twice, and the hardware processor executes feeding of the first sheet, formation of the first toner image, a fixation of the first toner image, and discharging of the first sheet by the first control, for the first job, executes feeding of the second sheet, formation of the second toner image, a fixation of the second toner image, re-feeding of the second sheet to the re-feeding path by the second control, a re-fixation of the second toner image, and discharging of the second sheet, for the second job, executes the feeding of the second sheet and the formation of the second toner image prior to the feeding of the first sheet and the formation of the first toner image, and executes the fixation of the first toner image and the re-feeding of the second sheet to the re-feeding path in an identical time slot.

10. The image forming apparatus according to claim 2, wherein the fixer fixes the toner image onto the sheet by heating and pressurization, and the re-feeding path guides the sheet having passed through the fixer toward the fixer such that a fixing surface of the toner image is thermo-compressed again.

11. A control method used in an image forming apparatus, which includes a fixer that fixes a toner image onto a sheet and a re-feeding path that normally conveys the sheet having passed through the fixer and guides the sheet toward the fixer, the control method comprising:

acquiring an image to be formed on the sheet;

switching between first control to discharge the sheet having passed through the fixer toward a discharge destination and second control to re-feed the sheet having passed through the fixer to the fixer through the re-feeding path, depending on a type of the acquired image which is a source of formation of the toner image, determining whether a partial image having a predetermined size or more in which all pixels have pixel values is included in the image, determining whether the partial image includes a superimposition of two or more reproduced colors, and switching to the first control when it is determined that the partial image is not included in the image, switching to the first control when it is determined that the partial image does not include the superimposition of two or more reproduced colors, and switching to the second control when it is determined that the partial image includes the superimposition of two or more reproduced colors.

* * * * *